US009110392B2

(12) United States Patent
Fukuri

(10) Patent No.: US 9,110,392 B2
(45) Date of Patent: Aug. 18, 2015

(54) TONERS FOR ELECTROPHOTOGRAPHY

(71) Applicant: KAO CORPORATION, Chuo-ku (JP)

(72) Inventor: Norihiro Fukuri, Wakayama (JP)

(73) Assignee: KAO CORPORATION, Chuo-ku (JP)

( * ) Notice: Subject to any disclaimer, the term of this patent is extended or adjusted under 35 U.S.C. 154(b) by 0 days.

(21) Appl. No.: 13/910,592

(22) Filed: Jun. 5, 2013

(65) Prior Publication Data

US 2013/0330666 A1 Dec. 12, 2013

(30) Foreign Application Priority Data

Jun. 7, 2012 (JP) ..... 2012-130078

(51) Int. Cl.
*G03G 9/087* (2006.01)
*G03G 9/093* (2006.01)

(52) U.S. Cl.
CPC ..... *G03G 9/08755* (2013.01); *G03G 9/09328* (2013.01); *G03G 9/09364* (2013.01); *G03G 9/09392* (2013.01)

(58) Field of Classification Search
USPC ..... 430/109.1, 109.3, 109.4, 110.2
See application file for complete search history.

(56) References Cited

U.S. PATENT DOCUMENTS

| | | | | |
|---|---|---|---|---|
| 2005/0271963 | A1* | 12/2005 | Shirai et al. | 430/109.3 |
| 2011/0229816 | A1* | 9/2011 | Shirai et al. | 430/109.4 |
| 2012/0171607 | A1* | 7/2012 | Ayaki et al. | 430/137.1 |

FOREIGN PATENT DOCUMENTS

| | | |
|---|---|---|
| JP | 2007-70622 | 3/2007 |
| JP | 2007-93809 | 4/2007 |
| JP | 2011-197192 | 10/2011 |
| JP | 2011-247932 | 12/2011 |

OTHER PUBLICATIONS

U.S. Appl. No. 13/910,630, filed Jun. 5, 2013, Fukuri.
U.S. Appl. No. 13/827,967, filed Mar. 14, 2013, Fukuri, et al.

* cited by examiner

*Primary Examiner* — Peter Vajda
(74) *Attorney, Agent, or Firm* — Oblon, McClelland, Maier & Neustadt, L.L.P.

(57) ABSTRACT

The present invention relates to a toner for electrophotography including core-shell particles each including a core containing a amorphous composite resin (A) which contains a segment (A1) formed of a polyester resin and a segment (A2) formed of a styrene-containing addition polymer as a constitutional unit thereof and a shell containing a amorphous resin (B) obtained by polycondensing an alcohol component containing an aliphatic diol having 2 to 6 carbon atoms with a carboxylic acid component.

19 Claims, No Drawings

TONERS FOR ELECTROPHOTOGRAPHY

FIELD OF THE INVENTION

The present invention relates to toners for electrophotography, and a process for producing the toners for electrophotography.

BACKGROUND OF THE INVENTION

With a high printing speed and energy saving of printing machines, there is an increasing demand for toners having an excellent low-temperature fusing property. However, when the toners are designed to have a low softening point or a low glass transition point in order to improve a low-temperature fixing property thereof, they tend to be deteriorated in heat-resistant storage property. Thus, the low-temperature fusing property and heat-resistant storage property of the toners are contradictory to each other.

In order to satisfy these contradictory properties, i.e., both the low-temperature fusing property and heat-resistant storage property of the toners, there have been proposed toners having a core-shell structure including a core portion and a shell portion formed of a resin different from that used for the core portion (for example, refer to Patent Document 1).

In addition, in order to further improve a low-temperature fusing property and a heat-resistant storage property of the toners, there have been developed technologies for producing the toners by using a hybrid resin having a chemical structure containing two kinds of molecular chains as a resin for the above core portion.

For example, Patent Document 2 discloses a toner of a core-shell type for development of electrostatic latent images in which a core layer contains core aggregates produced by aggregating core-forming particles containing a grafted polyester resin obtained by graft-polymerizing a polymerizable vinyl monomer with a polyester resin, a wax and a wax-dispersing aid for the purpose of improving a low-temperature fusing property and a storage stability of the toner having a core-shell structure.

Patent Document 3 discloses a toner for development of electrostatic latent images having a core-shell structure in which a shell is formed on a surface of respective core particles which include a resin binder containing a crystalline polyester resin and a non-crystalline polyester resin, and a colorant, and the core particles contain a composite resin formed by bonding a styrene-based resin and a polyester resin to each other for the purpose of improving a fixing latitude, a thermal storage property and a charging property of the resulting toner.

Patent Document 4 discloses resin particles of a core-shell type each including a shell layer formed of a resin (a) and a core layer formed of a resin (b) in which a weight ratio of the shell layer to the core layer is from 0.1:99.9 to 70:30, the resin (b) is formed of a polyester resin (b1) and/or a resin containing the polyester resin (b1) as a constitutional unit thereof, and further the resin (b1) is a polycondensed polyester resin obtained by subjecting a polyester to polycondensation reaction in the presence of a titanium-containing catalyst, for the purpose of improving a charging property, a heat-resistant storage property and thermal properties of the resulting toner.

PRIOR ART DOCUMENTS

Patent Documents

Patent Document 1: JP 2011-197192A
Patent Document 2: JP 2011-247932A
Patent Document 3: JP 2007-93809A
Patent Document 4: JP 2007-70622A

SUMMARY OF THE INVENTION

Thus, the present invention relates to the following aspects [1] and [2].

[1] A toner for electrophotography including core-shell particles each including a core containing a amorphous composite resin (A) which contains a segment (A1) formed of a polyester resin and a segment (A2) formed of a styrene-containing addition polymer as a constitutional unit thereof and a shell containing a amorphous resin (B) obtained by polycondensing an alcohol component containing an aliphatic diol having 2 to 6 carbon atoms with a carboxylic acid component.

[2] A process for producing a toner for electrophotography which includes core-shell particles, said process including the following steps 1 to 3:

Step 1: preparing an aqueous dispersion of resin particles I containing a amorphous composite resin (A) which contains a segment (A1) formed of a polyester resin and a segment (A2) formed of a styrene-containing addition polymer as a constitutional unit thereof;

Step 2: mixing the aqueous dispersion of the resin particles I obtained in the step 1 with a resin aqueous dispersion containing a amorphous resin (B) obtained by polycondensing an alcohol component containing an aliphatic diol having 2 to 6 carbon atoms with a carboxylic acid component to aggregate the resin particles I and the amorphous resin (B), thereby preparing an aqueous dispersion of resin particles II; and Step 3: coalescing the resin particles II obtained in the step 2.

DETAILED DESCRIPTION OF THE INVENTION

The toners of a core-shell type for development of electrostatic latent images as described in Patent Documents 2 to 4 tend to be improved in low-temperature fusing property and anti-hot offset property only to an insufficient extent. Therefore, it is demanded to develop a toner that is excellent in these properties.

The present invention relates to a toner for electrophotography which is excellent in low-temperature fusing property and anti-hot offset property, and a process for producing the toner.

The present inventors have found that when a amorphous composite resin containing a polyester component and a polystyrene component or a styrene-acryl copolymer component is used as a amorphous resin for a core and a amorphous resin obtained by polycondensing an alcohol component containing an aliphatic diol having 2 to 6 carbon atoms with a carboxylic acid component is used as a amorphous resin for a shell, it is possible to obtain a toner that is improved in both low-temperature fusing property and anti-hot offset property.

That is, the present invention relates to the following aspects [1] and [2].

[1] A toner for electrophotography including core-shell particles each including a core containing a amorphous composite resin (A) which contains a segment (A1) formed of a polyester resin and a segment (A2) formed of a styrene-containing addition polymer as a constitutional unit thereof and a shell containing a amorphous resin (B) obtained by polycondensing an alcohol component containing an aliphatic diol having 2 to 6 carbon atoms with a carboxylic acid component.

[2] A process for producing a toner for electrophotography which includes core-shell particles, said process including the following steps 1 to 3:

Step 1: preparing an aqueous dispersion of resin particles I containing a amorphous composite resin (A) which contains a segment (A1) formed of a polyester resin and a segment (A2) formed of a styrene-containing addition polymer as a constitutional unit thereof;

Step 2: mixing the aqueous dispersion of the resin particles I obtained in the step 1 with a resin aqueous dispersion containing a amorphous resin (B) obtained by polycondensing an alcohol component containing an aliphatic diol having 2 to 6 carbon atoms with a carboxylic acid component to aggregate the resin particles I and the amorphous resin (B), thereby preparing an aqueous dispersion of resin particles II; and Step 3: coalescing the resin particles II obtained in the step 2.

According to the present invention, there is provided a toner for electrophotography which is excellent in low-temperature fusing property and anti-hot offset property.

[Toner for Electrophotography]

The toner for electrophotography according to the present invention includes core-shell particles each including a core containing a amorphous composite resin (A) which contains a segment (A1) formed of a polyester resin and a segment (A2) formed of a styrene-containing addition polymer as a constitutional unit thereof and a shell containing a amorphous resin (B) obtained by polycondensing an alcohol component containing an aliphatic diol having 2 to 6 carbon atoms with a carboxylic acid component.

The toner for electrophotography according to the present invention is excellent in low-temperature fusing property and anti-hot offset property. The details of an entire mechanism capable of exhibiting these effects by the present invention are not necessarily clearly determined, but are considered as follows.

From the study on Patent Document 2, in the toner of a core-shell type for development of electrostatic latent images as described in Patent Document 2, a bisphenol type alcohol having a high hydrophobicity is used as an alcohol component constituting a amorphous polyester resin of the shell portion. In addition, the bisphenol type alcohol having a high hydrophobicity is also used as an alcohol component constituting a grafted polyester resin of the core portion. Further, a styrene having a high hydrophobicity is used as a polymerizable vinyl monomer constituting the grafted polyester resin. In general, a core-shell structure of the toner aims at causing a core portion and a shell portion of the toner to share its individual functions. However, the core and shell portions both having a high hydrophobic property tend to exhibit a compatibility therebetween and tend to be fused into each other so that the core-shell structure of the resulting toner tends to be insufficient. As a result, it is considered that since the core and shell portions fail to sufficiently exhibit their respective functions, it will be difficult for the resulting toner to satisfy both a good anti-hot offset property and a good low-temperature fusing property.

On the contrary, the toner according to the present invention has a good core-shell structure in which the core and shell are firmly bonded to each other without exhibiting an excessive compatibility therebetween, and it is therefore considered that the respective functions of the core and shell of the toner can be properly exhibited.

That is, the core has a high hydrophobicity because the amorphous composite resin (A) of the core contains the segment (A2) formed of a styrene-containing addition polymer as a constitutional unit thereof. Whereas, the shell exhibits a high ester group concentration and therefore has a high hydrophilicity because the aliphatic diol having 2 to 6 carbon atoms as a low-molecular weight compound is used as an alcohol component thereof. Thus, since the core and shell have a low compatibility therebetween owing to the high hydrophobicity of the core and the high hydrophilicity of the shell, it is considered that the resulting toner can sufficiently maintain its core-shell structure.

Further, since the core and shell both contain a polyester component and therefore have a similar molecular structure, it is considered that an adequate bonding force can act at a boundary between the core and shell through the similar molecular structure thereof. Thus, since the core and shell have not only a low compatibility therebetween but also an adequate bonding strength to each other. Therefore, it is considered that the core and shell are firmly bonded to each other without exhibiting an excessive compatibility therebetween to thereby form a good core-shell structure. For this reason, the toner of the present invention is capable of sufficiently exhibiting a performance of each of the core and shell. As a result, it is considered that the resulting toner is excellent in low-temperature fusing property and anti-hot offset property.

<Amorphous Composite Resin (A)>

The toner for electrophotography according to the present invention includes the core containing the amorphous composite resin (A) which contains the segment (A1) formed of a polyester resin and the segment (A2) formed of a styrene-containing addition polymer as a constitutional unit thereof.

The term "amorphous" as used in the present invention means that the amorphous resin has a crystallinity index of more than 1.4 or less than 0.6 wherein the crystallinity index is defined by a ratio of a softening point to an endothermic highest peak temperature as measured by a differential scanning colorimeter (DSC), i.e., "softening point (° C.)/endothermic maximum peak temperature (° C.)".

The amorphous composite resin (A) used in the present invention has a crystallinity index as defined above which is preferably in the range of less than 0.6 or more than 1.4 but not more than 4, more preferably less than 0.6 or not less than 1.5 but not more than 4, still more preferably less than 0.6 or not less than 1.5 but not more than 3, and especially preferably less than 0.6 or not less than 1.5 but not more than 2.5 from the viewpoints of a low-temperature fusing property, a heat-resistant storage property and an anti-hot offset property of the resulting toner. The crystallinity index of the amorphous composite resin (A) may be appropriately determined by controlling kinds and proportions of monomers used, production conditions or the like.

(Segment (A1) Formed of Polyester Resin)

The segment (A1) constituting the amorphous composite resin (A) used in the present invention is formed of a polyester resin.

The segment (A1) formed of a polyester resin contains constitutional units derived from an alcohol component and a carboxylic acid component of the polyester resin, and is preferably in the form of a polyester resin obtained by polycondensing the alcohol component and the carboxylic acid component.

[Alcohol Component]

Examples of the alcohol component as a constitutional unit, i.e., a raw material of the segment (A1) include at least one compound selected from the group consisting of an aromatic diol, an aliphatic diol and a trivalent or higher-valent polyhydric alcohol. Among these alcohols, from the viewpoints of a low-temperature fusing property, a heat-resistant storage property and an anti-hot offset property of the resulting toner, preferred is an aromatic diol.

When using the aromatic diol as the alcohol component of the segment (A1), the resin of the obtained core portion has an adequate affinity to the polyester resin of the shell portion. As a result, it is considered that the core and shell portions can maintain a good bonding strength to each other without causing excessive compatibilization at a boundary therebetween. Further, when using the aromatic diol as the alcohol component of the segment (A1), it is also possible to enhance a copolymerizability of the segment (A1) with an addition polymerization-type resin, and it is therefore considered that the resulting toner can be enhanced in low-temperature fusing property, heat-resistant storage property and anti-hot offset property.

The content of the aromatic diol in the alcohol component of the segment (A1) is preferably from 50 to 100 mol %, more preferably from 70 to 100 mol %, still more preferably from 80 to 100 mol % and especially preferably 100 mol % from the viewpoints of a low-temperature fusing property, a heat-resistant storage property and an anti-hot offset property of the resulting toner.

From the same viewpoints as described above, the aromatic diol is preferably an alkyleneoxide adduct of bisphenol A and more preferably a compound represented by the following general formula (I).

(1)

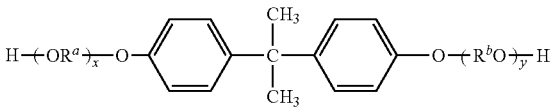

In the general formula (I), $R^aO$ and $R^bO$ are respectively an alkyleneoxy group, preferably each independently an alkyleneoxy group having 1 to 4 carbon atoms and more preferably an ethyleneoxy group or a propyleneoxy group.

The suffixes x and y each represent a molar number of addition of alkyleneoxides and are each a positive number. The average value of a sum of x and y is preferably from 1 to 16, more preferably from 1 to 8 and still more preferably from 1.5 to 4, and the sum of x and y is preferably from 1 to 16, more preferably from 1 to 8 and still more preferably from 2 to 4 from the viewpoint of a good reactivity of the alcohol component with the carboxylic acid component.

In addition, a plurality of $R^aO$ groups in the number of x and a plurality of $R^bO$ groups in the number of y may be respectively identical to or different from each other, and are preferably identical to each other from the viewpoint of obtaining uniform emulsified particles, and more preferably are respectively an ethyleneoxy group or a propyleneoxy group.

From the viewpoints of forming a uniform core-shell structure and enhancing a low-temperature fusing property, a heat-resistant storage property and an anti-hot offset property of the resulting toner, the content of the ethyleneoxy group and the propyleneoxy group in the alkyleneoxy group is preferably from 50 to 100 mol %, more preferably from 80 to 100 mol %, still more preferably substantially 100 mol %, and especially preferably 100 mol %.

The alkyleneoxide adducts of 2,2-bis(4-hydroxyphenyl) propane may be used alone or in combination of any two or more thereof. It is preferable to use a mixture of a propyleneoxide adduct of 2,2-bis(4-hydroxyphenyl)propane and an ethyleneoxide adduct of 2,2-bis(4-hydroxyphenyl)propane. The mixing molar ratio of the propyleneoxide adduct of 2,2-bis(4-hydroxyphenyl)propane to the ethyleneoxide adduct of 2,2-bis(4-hydroxyphenyl)propane is preferably from 50/50 to 99/1, more preferably from 60/40 to 80/20 and still more preferably from 65/35 to 75/25 from the viewpoints of a low-temperature fusing property, a heat-resistant storage property and an anti-hot offset property of the resulting toner.

The content of the alkyleneoxide adduct of 2,2-bis(4-hydroxyphenyl)propane in the alcohol component of the segment (A1) is preferably 50 mol % or more, more preferably 70 mol % or more, still more preferably 80 mol % or more, further still more preferably substantially 100 mol % and especially preferably 100 mol % from the viewpoints of a low-temperature fusing property, a heat-resistant storage property and an anti-hot offset property of the resulting toner. More specifically, the content of the alkyleneoxide adduct of 2,2-bis(4-hydroxyphenyl)propane in the alcohol component is preferably from 50 to 100 mol %, more preferably from 70 to 100 mol %, still more preferably from 80 to 100 mol %, further still more preferably substantially 100 mol %, and especially preferably 100 mol %. Meanwhile, the alkyleneoxide adduct as used in the present invention means a whole structure obtained by adding an alkyleneoxy group to 2,2-bis (4-hydroxyphenyl)propane.

The aliphatic diol is preferably an aliphatic diol having 2 to 6 carbon atoms from the viewpoints of a low-temperature fusing property, a heat-resistant storage property and an anti-hot offset property of the resulting toner.

The number of carbon atoms of the aliphatic diol having 2 to 6 carbon atoms is preferably from 3 to 5, and more preferably from 3 to 4 from the viewpoints of a low-temperature fusing property, a heat-resistant storage property and an anti-hot offset property of the resulting toner.

The aliphatic diol having 2 to 6 carbon atoms is preferably a linear or branched aliphatic diol, and more preferably a branched aliphatic diol from the viewpoints of a heat-resistant storage property of the resulting toner.

Examples of the aliphatic diol having 2 to 6 carbon atoms include at least one compound selected from the group consisting of ethylene glycol, 1,2-propanediol, 1,3-propanediol, 1,2-butanediol, 1,3-butanediol, 1,4-butanediol, 2,3-butanediol, 1,2-pentanediol, 1,3-pentanediol, 1,4-pentanediol, 1,5-pentanediol, neopentyl glycol, 2,3-pentanediol, 2,4-pentanediol, 1,2-hexanediol, 1,3-hexanediol, 1,4-hexanediol, 1,5-hexanediol and 1,6-hexanediol. Among these aliphatic diols, from the viewpoints of a low-temperature fusing property, a heat-resistant storage property and an anti-hot offset property of the resulting toner, preferred is at least one compound selected from the group consisting of 2,3-butanediol, 1,2-propanediol, neopentyl glycol and ethylene glycol.

[Carboxylic Acid Component]

Examples of the carboxylic acid component as a constitutional unit, i.e., a raw material of the segment (A1) include a dicarboxylic acid compound and a trivalent or higher-valent polycarboxylic acid compound. Meanwhile, these carboxylic acid compounds as used in the present invention are intended to include a carboxylic acid, an anhydride of the carboxylic acid, and a derivative of the carboxylic acid such as an alkyl ester of the carboxylic acid.

Examples of the dicarboxylic acid compound include aliphatic dicarboxylic acids such as oxalic acid, malonic acid, maleic acid, fumaric acid, citraconic acid, itaconic acid, glutaconic acid, succinic acid, an alkenyl succinic acid, adipic acid, sebacic acid and azelaic acid; aromatic dicarboxylic acids such as phthalic acid, isophthalic acid and terephthalic acid; alicyclic dicarboxylic acids such as cyclohexanedicarboxylic acid; and anhydrides and alkyl ($C_1$ to $C_3$) esters of these acids.

Among these dicarboxylic acid compounds, from the viewpoints of a low-temperature fusing property and a charging stability of the resulting toner, preferred are aliphatic dicarboxylic acid compounds and aromatic dicarboxylic acid compounds, and more preferred are aromatic dicarboxylic acid compounds. Examples of the preferred aromatic dicarboxylic acid compounds include at least one compound selected from the group consisting of phthalic acid, isophthalic acid and terephthalic acid. Among these aromatic dicarboxylic acid compounds, more preferred is terephthalic acid.

Specific examples of the preferred dicarboxylic acid compounds include at least one compound selected from the group consisting of fumaric acid, an alkenyl succinic acid, phthalic acid, isophthalic acid and terephthalic acid. Among these dicarboxylic acid compounds, more preferred is at least one compound selected from the group consisting of fumaric acid, an alkenyl succinic acid and terephthalic acid, and especially preferred is terephthalic acid.

The content of the aromatic dicarboxylic acid compound in the carboxylic acid component of the segment (A1) is preferably from 30 to 95 mol %, more preferably from 50 to 90 mol %, still more preferably from 53 to 85 mol % and especially preferably from 55 to 83 mol % from the viewpoints of a low-temperature fusing property, a heat-resistant storage property and an anti-hot offset property of the resulting toner.

Examples of the trivalent or higher-valent polycarboxylic acid compound include aromatic carboxylic acids such as 1,2,4-benzenetricarboxylic acid (trimellitic acid), 2,5,7-naphthalenetricarobxylic acid and pyromellitic acid; and derivatives of these acids such as anhydrides and alkyl ($C_1$ to $C_3$) esters of these acids.

In the present invention, the carboxylic acid component preferably contains the trivalent or higher-valent polycarboxylic acid compound, more preferably a trimellitic acid compound and still more preferably trimellitic anhydride from the viewpoints of increasing a molecular weight of the obtained resin, promoting formation of the amorphous resin, and enhancing a heat-resistant storage property and an anti-hot offset property of the resulting toner. From the same viewpoints, the content of the trivalent or higher-valent polycarboxylic acid compound in the carboxylic acid component is preferably from 0.1 to 30 mol %, more preferably from 1 to 30 mol %, still more preferably from 10 to 30 mol %, and especially preferably from 15 to 25 mol %.

[Molar Ratio Between Alcohol Component and Carboxylic Acid Component of Segment (A1) Constituting Amorphous Composite Resin (A) or the Like]

The molar ratio of the carboxylic acid component to the alcohol component (carboxylic acid component/alcohol component) of the segment (A1) constituting the amorphous composite resin (A) used in the present invention is preferably from 0.60 to 1.2, more preferably from 0.65 to 1.0 and still more preferably from 0.70 to 0.90 from the viewpoint of enhancing a low-temperature fusing property and a charging stability of the resulting toner.

The alcohol component and the carboxylic acid component of the segment (A1) preferably contain the compound represented by the general formula (I) and terephthalic acid, respectively. Preferred examples of combination of the alcohol component and the carboxylic acid component include combination of the compound represented by the general formula (I), terephthalic acid and trimellitic anhydride, combination of the compound represented by the general formula (I), terephthalic acid, trimellitic anhydride and an alkenyl succinic anhydride, and combination of the compound represented by the general formula (I), terephthalic acid and fumaric acid.

(Segment (A2))

The segment (A2) constituting the amorphous composite resin (A) used in the present invention is formed of a styrene-containing addition polymer as a constitutional unit thereof.

As a monomer as a constitutional unit of the segment (A2), from the viewpoints of a good availability of the monomer as well as a low-temperature fusing property, a heat-resistant storage property and an anti-hot offset property of the resulting toner, there is preferably used styrene solely or combination of styrene and a (meth)acrylic acid ester, and more preferably combination of styrene and a (meth)acrylic acid ester.

The content of the styrene-containing addition polymer as the constitutional unit in the segment (A2) is preferably from 60 to 100% by mass, more preferably from 80 to 100% by mass, still more preferably from 90 to 100% by mass, further still more preferably substantially 100% by mass, and especially preferably 100% by mass from the viewpoints of a low-temperature fusing property, a heat-resistant storage property and an anti-hot offset property of the resulting toner.

[Styrene]

When using styrene as the monomer for the segment (A2), the content of a constitutional unit derived from styrene in the segment (A2) is preferably from 60 to 100% by mass, more preferably from 70 to 90% by mass, still more preferably from 75 to 85% by mass, and especially preferably from 80 to 85% by mass from the viewpoints of a low-temperature fusing property, a heat-resistant storage property and an anti-hot offset property of the resulting toner.

[(Meth)Acrylic Acid Ester]

Examples of the (meth)acrylic acid ester include an alkyl (meth)acrylate (containing an alkyl group having 1 to 18 carbon atoms), benzyl (meth)acrylate and dimethylaminoethyl (meth)acrylate. Among these (meth)acrylic acid esters, from the viewpoints of a low-temperature fusing property, a heat-resistant storage property and an anti-hot offset property of the resulting toner, preferred is an alkyl(meth)acrylate containing an alkyl group having 1 to 18 carbon atoms, more preferred is an alkyl(meth)acrylate containing an alkyl group having 4 to 12 carbon atoms, still more preferred is an alkyl (meth)acrylate containing an alkyl group having 8 to 12 carbon atoms such as 2-ethylhexyl acrylate, and especially preferred is 2-ethylhexyl acrylate.

When using the (meth)acrylic acid ester as the monomer for the segment (A2), the content of a constitutional unit derived from the (meth)acrylic acid ester in the segment (A2) is preferably from 5 to 40% by mass, more preferably from 10 to 30% by mass, still more preferably from 15 to 25% by mass, and especially preferably from 15 to 20% by mass from the viewpoints of a low-temperature fusing property, a heat-resistant storage property and an anti-hot offset property of the resulting toner.

[Bireactive Monomer]

The segment (A2) preferably contains a bireactive monomer serving as a bonding site to the polyester resin of the segment (A1). The "bireactive monomer" as used herein means a monomer capable of undergoing both an addition polymerization reaction and a polycondensation reaction.

The bireactive monomer is preferably a carboxyl group-containing vinyl monomer. Specific examples of the carboxyl group-containing vinyl monomer include acrylic acid, methacrylic acid, crotonic acid, tiglic acid, 2-pentenoic acid, 4-pentenoic acid, 2-methyl-2-pentenoic acid, 4-methyl-2-pentenoic acid, 2-hexenoic acid and 5-hexenoic acid. Among these carboxyl group-containing vinyl monomers, from the viewpoint of a good polymerizability, at least one of acrylic acid and methacrylic acid is preferred, and acrylic acid is more preferred.

From the viewpoints of a good dispersibility of the styrene-containing addition polymer as a constitutional unit of the segment (A2) in the polyester resin and well-controlled conditions of the addition polymerization reaction and polycondensation reaction, the bireactive monomer is preferably used in an amount of from 1 to 40 mol parts, more preferably from 5 to 30 mol parts, still more preferably from 5 to 20 mol parts and especially preferably from 10 to 16 mol parts on the basis of 100 mol parts of a total amount of the carboxylic acid component as the monomer of the polyester resin in the segment (A1).

(Properties of Amorphous Composite Resin (A) or the Like)

The weight-average molecular weight of the amorphous composite resin (A) is preferably from 1,500 to 50,000, more preferably from 5,000 to 45,000, still more preferably 10,000 to 43,000, and especially preferably from 15,000 to 40,000 from the viewpoints of a low-temperature fusing property, a heat-resistant storage property and an anti-hot offset property of the resulting toner.

The number-average molecular weight of the amorphous composite resin (A) is preferably from 800 to 7,000, more preferably from 1,000 to 5,000, still more preferably 2,000 to 4,000, further still more preferably 2,500 to 3,500 and especially preferably from 2,500 to 3,300 from the viewpoints of a low-temperature fusing property, a heat-resistant storage property and an anti-hot offset property of the resulting toner.

The acid value of the amorphous composite resin (A) is preferably from 5 to 40 mg KOH/g, more preferably from 10 to 30 mg KOH/g and still more preferably from 20 to 25 mg KOH/g from the viewpoints of a good dispersion stability of a resin particle dispersion containing the amorphous composite resin (A), production of uniform toner particles and a good charging property of the resulting toner.

The softening point of the amorphous composite resin (A) is preferably from 80 to 150° C., more preferably from 85 to 130° C. and still more preferably from 90 to 120° C. from the viewpoints of a low-temperature fusing property, a heat-resistant storage property and an anti-hot offset property of the resulting toner.

The glass transition temperature of the amorphous composite resin (A) is preferably from 40 to 80° C., more preferably from 45 to 70° C. and still more preferably from 50 to 60° C. from the viewpoints of a low-temperature fusing property, a heat-resistant storage property and an anti-hot offset property of the resulting toner.

The endothermic maximum peak temperature of the amorphous composite resin (A) is preferably from 45 to 75° C. and more preferably from 50 to 65° C. from the viewpoints of a low-temperature fusing property, a heat-resistant storage property and an anti-hot offset property of the resulting toner.

Meanwhile, the weight-average molecular weight, the number-average molecular weight, the acid value, the softening point, the glass transition point and the endothermic maximum peak temperature of the amorphous composite resin (A) may be measured by the methods described in Examples below.

In addition, the amorphous composite resin (A) may be used alone or in combination of any two or more kinds thereof. When the amorphous resin (B) is used in the form of a mixture containing two or more kinds of resins, the softening point of the amorphous composite resin (A) means a softening point of the mixture of the resins as measured by the method described in Examples below.

The proportion of the segment (A2) on the basis of a total amount of the segment (A1) and the segment (A2) is preferably from 5 to 50% by mass, more preferably from 10 to 45% by mass, still more preferably from 20 to 40% by mass and especially preferably from 25 to 35% by mass from the viewpoints of a low-temperature stability, a heat-resistant storage property and an anti-hot offset property of the resulting toner.

The mass ratio of the segment (A1) to the segment (A2) [(A1)/(A2)] is preferably from 50/50 to 95/9, more preferably from 65/35 to 90/10, still more preferably from 60/40 to 80/20 and especially preferably from 65/35 to 75/25 from the viewpoints of a low-temperature stability, a heat-resistant storage property and an anti-hot offset property of the resulting toner.

The total amount of the segment (A1) and the segment (A2) in the amorphous composite resin (A) is preferably from 60 to 100% by mass, more preferably from 80 to 100% by mass, still more preferably from 90 to 100% by mass, further still more preferably substantially 100% by mass, and especially preferably 100% by mass from the viewpoints of a low-temperature stability, a heat-resistant storage property and an anti-hot offset property of the resulting toner.

The content of the amorphous composite resin (A) in the core-shell particles is preferably from 46 to 90% by mass, more preferably from 50 to 83% by mass, still more preferably from 59 to 83% by mass, further still more preferably from 67 to 83% by mass, further still more preferably from 71 to 80% by mass, and especially preferably from 74 to 80% by mass on the basis of a total amount of the resins contained in the core-shell particles from the viewpoints of a low-temperature stability, a heat-resistant storage property and an anti-hot offset property of the resulting toner.

The content of the amorphous composite resin (A) in the core is preferably from 60 to 100% by mass, more preferably from 80 to 100% by mass, still more preferably from 90 to 100% by mass, and further still more preferably substantially 100% by mass on the basis of a total amount of the resins contained in the core from the viewpoints of a low-temperature stability, a heat-resistant storage property and an anti-hot offset property of the resulting toner.

<Amorphous Resin (B)>

In the toner for electrophotography according to the present invention, the shell contains the amorphous resin (B) obtained by polycondensing an alcohol component containing an aliphatic diol having 2 to 6 carbon atoms with a carboxylic acid component.

The crystallinity index of the amorphous resin (B) is preferably less than 0.6 or more than 1.4 but not more than 4, more preferably less than 0.6 or not less than 1.5 but not more than 4, still more preferably less than 0.6 or not less than 1.5 but not more than 3, and especially preferably less than 0.6 or not less than 1.5 but not more than 2.5 from the viewpoints of a low-temperature fusing property, a heat-resistant storage property and an anti-hot offset property of the resulting toner. The crystallinity index of the amorphous resin (B) may be appropriately determined by controlling kinds and proportions of monomers used, production conditions or the like.

(Alcohol Component)

The alcohol component as the monomer of the amorphous resin (B) contains an aliphatic diol having 2 to 6 carbon atoms from the viewpoints of increasing an ester value of the obtained resin and enhancing a low-temperature fusing property, a heat-resistant storage property and an anti-hot offset property of the resulting toner.

Specific examples of the aliphatic diol having 2 to 6 carbon atoms include the same aliphatic diols as described for the amorphous composite resin (A). Among these aliphatic diols, from the viewpoints of increasing an ester value of the obtained resin and enhancing a low-temperature fusing property, a heat-resistant storage property and an anti-hot offset property of the resulting toner, preferred is at least one compound selected from the group consisting of 2,3-butanediol, 1,2-propanediol, neopentyl glycol and ethylene glycol, and more preferred is 1,2-propanediol.

The content of the aliphatic diol having 2 to 6 carbon atoms in the alcohol component of the amorphous resin (B) is preferably from 80 to 100 mol %, more preferably from 90 to 100 mol %, still more preferably from 95 to 100 mol %, further still more preferably substantially 100 mol % and most preferably 100 mol % from the viewpoints of a low-temperature fusing property and a charging stability of the resulting toner.

Examples of the other alcohol components than the aliphatic diol having 2 to 6 carbon atoms include an aliphatic diol having 7 or more carbon atoms, a trivalent or higher-valent alcohol such as glycerin, and an alkyleneoxide adduct of bisphenol A represented by the above formula (I). However, from the viewpoints of reducing a compatibility between the amorphous resin (B) and the amorphous composite resin (A) to sufficiently maintain a core-shell structure of the toner and imparting an adequate bonding strength between the core and shell, the alcohol component preferably contains no other alcohol components than the aliphatic diol having 2 to 6 carbon atoms.

(Carboxylic Acid Component)

Examples of the carboxylic acid component as a constitutional unit, i.e., a raw material of the amorphous resin (B) include a dicarboxylic acid compound and a trivalent or higher-valent polycarboxylic acid compound.

Examples of the dicarboxylic acid compound include aliphatic dicarboxylic acids such as oxalic acid, malonic acid, maleic acid, fumaric acid, citraconic acid, itaconic acid, glutaconic acid, succinic acid, an alkenyl succinic acid, adipic acid, sebacic acid and azelaic acid; aromatic dicarboxylic acids such as phthalic acid, isophthalic acid and terephthalic acid; alicyclic dicarboxylic acids such as cyclohexanedicarboxylic acid; and anhydrides and alkyl ($C_1$ to $C_3$) esters of these acids.

Among these dicarboxylic acid compounds, from the viewpoints of a low-temperature fusing property, a heat-resistant storage property and an anti-hot offset property of the resulting toner, preferred are aliphatic dicarboxylic acid compounds and aromatic dicarboxylic acid compounds, and more preferred are aromatic dicarboxylic acid compounds. More specifically, among the above dicarboxylic acid compounds, preferred is at least one compound selected from the group consisting of fumaric acid, an alkenyl succinic anhydride, phthalic acid, isophthalic acid and terephthalic acid, more preferred is at least one compound selected from the group consisting of fumaric acid, an alkenyl succinic anhydride, isophthalic acid and terephthalic acid, still more preferred is at least one compound selected from the group consisting of isophthalic acid and terephthalic acid, and especially preferred is terephthalic acid.

The carboxylic acid component preferably contains the aromatic dicarboxylic acid compound from the viewpoints of a low-temperature fusing property, a heat-resistant storage property and an anti-hot offset property of the resulting toner. The content of the aromatic dicarboxylic acid compound in the carboxylic acid component of the amorphous resin (B) is preferably from 30 to 95 mol %, more preferably from 50 to 90 mol %, still more preferably from 60 to 85 mol %, further still more preferably from 70 to 85 mol % and especially preferably from 75 to 85 mol % from the viewpoints of a low-temperature fusing property, a heat-resistant storage property and an anti-hot offset property of the resulting toner.

Examples of the trivalent or higher-valent polycarboxylic acid compound as the carboxylic acid component of the amorphous resin (B) include at least one compound selected from the group consisting of aromatic carboxylic acids such as 1,2,4-benzenetricarboxylic acid (trimellitic acid), 2,5,7-naphthalenetricarobxylic acid and pyromellitic acid; and derivatives of these acids such as anhydrides and alkyl ($C_1$ to $C_3$) esters of these acids.

Examples of the other carboxylic acid compound include unpurified rosin, purified rosin and rosins modified with fumaric acid, maleic acid, acrylic acid, etc.

In the present invention, the carboxylic acid component of the amorphous resin (B) preferably contains the trivalent or higher-valent polycarboxylic acid compound, more preferably a trimellitic acid compound and still more preferably trimellitic anhydride from the viewpoints of increasing a molecular weight of the obtained resin, promoting formation of the amorphous resin, and enhancing a heat-resistant storage property and an anti-hot offset property of the resulting toner. From the same viewpoints, the content of the trivalent or higher-valent polycarboxylic acid compound in the carboxylic acid component is preferably from 0.1 to 30 mol %, more preferably from 1 to 25 mol %, still more preferably from 10 to 20 mol %, and especially preferably from 15 to 20 mol %.

[Molar Ratio Between Alcohol Component and Carboxylic Acid Component in Amorphous Resin (B), or the Like]

The molar ratio of the carboxylic acid component to the alcohol component (carboxylic acid component/alcohol component) in the amorphous resin (B) is preferably from 0.7 to 1.2, more preferably from 0.7 to 1.1 and still more preferably from 0.75 to 1.0 from the viewpoint of enhancing a low-temperature fusing property and a charging stability of the resulting toner.

(Properties of Amorphous Resin (B) or the Like)

The weight-average molecular weight of the amorphous resin (B) is preferably from 1,000 to 50,000, more preferably from 2,000 to 30,000, still more preferably from 3,000 to 25,000 and especially preferably from 5,000 to 20,000 from the viewpoints of a low-temperature fusing property, a heat-resistant storage property and an anti-hot offset property of the resulting toner.

The number-average molecular weight of the amorphous resin (B) is preferably from 800 to 7,000, more preferably from 1,000 to 5,000, still more preferably from 2,000 to 4,000 and especially preferably from 2,300 to 3,500 from the viewpoints of a low-temperature fusing property, a heat-resistant storage property and an anti-hot offset property of the resulting toner.

The acid value of the amorphous resin (B) is preferably from 6 to 35 mg KOH/g, more preferably from 15 to 35 mg KOH/g and still more preferably from 20 to 30 mg KOH/g from the viewpoint of a good emulsifying property of the resin in an aqueous medium.

From the viewpoints of a low-temperature fusing property, a heat-resistant storage property and an anti-hot offset property of the resulting toner, the softening point of the amorphous resin (B) is preferably from 70 to 165° C., more preferably from 90 to 140° C., still more preferably from 100 to 135° C. and especially preferably from 110 to 125° C.

The glass transition point of the amorphous resin (B) is preferably from 50 to 80° C., more preferably from 55 to 75° C. and still more preferably from 60 to 70° C. from the viewpoints of a low-temperature fusing property, a heat-resistant storage property and an anti-hot offset property of the resulting toner.

The endothermic maximum peak temperature of the amorphous resin (B) is preferably from 50 to 75° C. and more preferably from 50 to 70° C. from the viewpoints of a low-temperature fusing property, a heat-resistant storage property and an anti-hot offset property of the resulting toner, Meanwhile, the weight-average molecular weight, the number-average molecular weight, the acid value, the softening point, the glass transition point and the endothermic maximum peak temperature of the amorphous resin (B) may be measured by the methods described in Examples below.

In addition, when the amorphous resin (B) is in the form of a mixture containing two or more kinds of resins, the above-mentioned characteristic values of the amorphous resin (B) respectively mean those of the mixture of the resins as measured by the methods described in Examples below.

The content of the amorphous resin (B) in the core-shell particles is preferably from 10 to 54% by mass, more preferably from 17 to 50% by mass, still more preferably from 17 to 41% by mass, further still more preferably from 17 to 33% by mass, further still more preferably from 20 to 29% by mass, and especially preferably from 20 to 26% by mass on the basis of a total amount of the resins contained in the core-shell particles from the viewpoints of a low-temperature fusing property, a heat-resistant storage property and an anti-hot offset property of the resulting toner.

The content of the amorphous resin (B) in the shell is preferably from 60 to 100% by mass, more preferably from 80 to 100% by mass, still more preferably from 90 to 100% by mass, further still more preferably substantially 100% by mass, and especially preferably 100% by mass on the basis of a total amount of the resins contained in the shell from the viewpoints of a low-temperature fusing property, a heat-resistant storage property and an anti-hot offset property of the resulting toner.

The mass ratio of the amorphous resin (B) on the basis of 100 parts by mass of the amorphous composite resin (A) is preferably from 10 to 120 parts by mass, more preferably from 20 to 100 parts by mass, still more preferably from 20 to 70 parts by mass, further still more preferably from 20 to 50 parts by mass, further still more preferably from 25 to 40 parts by mass and especially preferably from 25 to 35 parts by mass from the viewpoints of a low-temperature fusing property, a heat-resistant storage property and an anti-hot offset property of the resulting toner.

<Crystalline Polyester>

In the core-shell particles used in the present invention, the core portion may further contain a crystalline polyester from the viewpoint of a good low-temperature fusing property of the resulting toner.

The kind of an alcohol component of the crystalline polyester is the same as the alcohol component of the amorphous composite resin (A) as described above. From the viewpoints of increasing a crystallinity of the obtained resin and enhancing a low-temperature fusing property of the resulting toner, the alcohol component is preferably an aliphatic diol, more preferably an aliphatic diol having 2 to 6 carbon atoms and still more preferably 1,6-hexanediol. The kind of a carboxylic acid component of the crystalline polyester is also the same as the carboxylic acid component of the amorphous composite resin (A) as described above. From the viewpoint of enhancing a low-temperature fusing property of the resulting toner, the carboxylic acid component is preferably a dicarboxylic acid compound, more preferably an aliphatic dicarboxylic acid and still more preferably fumaric acid.

The crystalline polyester as used in the present invention means a resin having a ratio of a softening point to an endothermic maximum peak temperature (softening point CC)/endothermic maximum peak temperature CC)) of from 0.6 to 1.4, preferably from 0.9 to 1.2 and more preferably from 1.0 to 1.2 as measured by the method described in Examples below.

[Properties of Crystalline Polyester or the Like]

The number-average molecular weight of the crystalline polyester used in the present invention is not particularly limited, and is preferably from 1,000 to 6,000, more preferably from 1,000 to 5,000 and still more preferably from 1,500 to 4,500 from the viewpoints of enhancing a low-temperature fusing property of the resulting toner and enhancing a heat-resistant storage property and an anti-hot offset property of the resulting toner.

The weight-average molecular weight of the crystalline polyester used in the present invention is preferably from 3,000 to 100,000, more preferably from 5,000 to 50,000, still more preferably from 5,000 to 30,000 and especially preferably from 7,000 to 20,000 from the viewpoints of enhancing a low-temperature fusing property of the resulting toner and enhancing a heat-resistant storage property and an anti-hot offset property of the resulting toner.

Meanwhile, in the present invention, the number-average molecular weight and the weight-average molecular weight of the crystalline polyester respectively mean the value as measured with respect to a chloroform soluble component in the crystalline polyester by the method described in Examples below.

The acid value of the crystalline polyester used in the present invention is preferably from 1 to 40 mg KOH/g, more preferably from 2 to 35 mg KOH/g, still more preferably from 3 to 30 mg KOH/g and especially preferably from 15 to 25 mg KOH/g from the viewpoints of well dispersing the crystalline polyester in an aqueous dispersion and enhancing a low-temperature fusing property, a heat-resistant storage property and an anti-hot offset property of the resulting toner.

From the viewpoints of a low-temperature fusing property, a heat-resistant storage property and an anti-hot offset property of the resulting toner, the crystalline polyester used in the present invention preferably has a softening point of from 60 to 160° C., more preferably from 80 to 140° C., still more preferably from 100 to 120° C. and especially preferably from 110 to 120° C.

The melting point of the crystalline polyester used in the present invention is preferably from 60 to 150° C., more preferably from 80 to 130° C., still more preferably from 100 to 120° C. and especially preferably from 105 to 115° C. from the viewpoints of a low-temperature fusing property, a charging property, an environmental stability and a heat-resistant storage property of the resulting toner.

Meanwhile, the acid value, the softening point and the melting point of the crystalline polyester may be measured by the methods described in Examples below.

In addition, the weight-average molecular weight, the number-average molecular weight, the softening point, the melting point and the acid value of the crystalline polyester may be readily adjusted by appropriately controlling a composition of the monomers, a polymerization initiator, a molecular weight, an amount of a catalyst used, etc., or selecting suitable reaction conditions.

The mass ratio of the crystalline polyester when used in the core portion is as follows.

The mass ratio of the crystalline polyester to the amorphous composite resin (A) [crystalline polyester/amorphous composite resin (A)] in the core portion is preferably from 5/95 to 40/60, more preferably from 8/92 to 30/70 and still more preferably from 10/90 to 25/75 from the viewpoints of a low-temperature fusing property, a heat-resistant storage property and an anti-hot offset property of the resulting toner.

The mass ratio of the crystalline polyester to a total amount of the amorphous composite resin (A) and the amorphous resin (B) [(A)+(B)] in the core-shell particles {crystalline polyester/[(A)+(B)]} is preferably from 5/95 to 40/60, more preferably from 10/90 to 25/75 and still more preferably from 15/85 to 20/80 from the viewpoints of a low-temperature fusing property, a heat-resistant storage property and an anti-hot offset property of the resulting toner.

<Releasing Agent>

In the toner according to the present invention, a releasing agent is preferably contained in the core portion.

When the releasing agent is exposed to a surface of the toner, the resulting toner tends to be deteriorated in anti-hot offset property. However, in the present invention, the amorphous composite resin of the core portion contains the segment (A2) formed of the styrene-containing addition polymer as a constitutional unit thereof which is excellent in compatibility with the releasing agent, so that the resulting toner can exhibit an excellent anti-hot offset property. From the viewpoint of attaining the excellent anti-hot offset property, the mass ratio of the segment (A1) to the segment (A2) [(A1)/(A2)] is preferably from 50/50 to 95/5, more preferably from 65/35 to 90/10, still more preferably from 60/40 to 80/20 and especially preferably from 65/35 to 75/25.

When using the releasing agent in the core portion, the mass ratio of the releasing agent to a total amount of resins contained in the core portion [(releasing agent)/(total amount of resins contained in core portion)] is preferably from 0.001 to 0.1, more preferably from 0.005 to 0.05 and still more preferably from 0.01 to 0.03 from the viewpoints of a low-temperature fusing property, a heat-resistant storage property and an anti-hot offset property of the resulting toner.

The mass ratio of the releasing agent to a total amount of the amorphous composite resin (A) and the amorphous resin (B) contained in the core-shell particles {(releasing agent)/[(A)+(B)]} is preferably from 0.001 to 0.1, more preferably from 0.005 to 0.05 and still more preferably from 0.01 to 0.02 from the viewpoints of a low-temperature fusing property, a heat-resistant storage property and an anti-hot offset property of the resulting toner.

Examples of the releasing agent include low-molecular weight polyolefins such as polyethylene, polypropylene and polybutene; silicones exhibiting a softening point by heating; fatty acid amides such as oleamide, erucamide, ricinolamide and stearamide; vegetable waxes such as carnauba wax, rice wax, candelilla wax, haze wax and jojoba oil; animal waxes such as beeswax; and mineral and petroleum-based waxes such as montan wax, paraffin wax, ozokerite, ceresin, microcrystalline wax and Fischer-Tropsch wax. Among these releasing agents, paraffin wax is preferably used from the viewpoints of a low-temperature fusing property and an anti-hot offset property of the resulting toner as well as a good availability thereof. These releasing agents may be used alone or in combination of any two or more thereof.

The releasing agent is preferably used in the form of a dispersion of releasing agent particles prepared by dispersing the releasing agent in an aqueous medium from the viewpoints of a good dispersing property of the releasing agent in a resin as well as a good aggregating property of the releasing agent with the resin particles.

<Method for Producing Polyester-Based Resin>

The method for producing the polyester-based resin is not particularly limited. The polyester-based resin may be produced by any known methods in which an alcohol component and a carboxylic acid component are subjected to polycondensation reaction. The polycondensation reaction is preferably carried out in the presence of an esterification catalyst. From the viewpoints of well controlling a reactivity and a molecular weight as well as properties of the resulting resin, the polycondensation reaction is more preferably carried out in the presence of both the esterification catalyst and a pyrogallol compound.

The polyester-based resin as used herein means the amorphous composite resin (A), the crystalline polyester and the amorphous resin (B) as described above, or the like.

(Esterification Catalyst)

Examples of the esterification catalyst suitably used in the polycondensation reaction include titanium compounds and tin (II) compounds containing no Sn—C bond. These titanium compounds and tin compounds as the esterification catalyst may be used alone or in combination of any two or more thereof.

The titanium compound is preferably a titanium compound having a Ti—O bond and more preferably a titanium compound containing an alkoxy group, an alkenyloxy group or an acyloxy group having 1 to 28 carbon atoms in total.

Examples of the preferred tin (II) compound containing no Sn—C bond include tin (II) compounds having an Sn—O bond and tin (II) compounds having an Sn—X bond wherein X represents a halogen atom. Among these tin compounds, preferred are tin (II) compounds having an Sn—O bond. In particular, from the viewpoint of well controlling a reactivity and a molecular weight as well as properties of the resulting resin, more preferred is tin (II) 2-ethyl hexanoate.

The amount of the esterification catalyst being present in the reaction system is preferably from 0.01 to 2 part by mass, more preferably from 0.02 to 1 part by mass and still more preferably from 0.1 to 0.6 part by mass on the basis of 100 parts by mass of a total amount of the alcohol component and the carboxylic acid component from the viewpoints of well controlling a reactivity and a molecular weight as well as properties of the resulting resin.

(Pyrogallol Compound)

The pyrogallol compound is a compound containing a benzene ring in which three hydrogen atoms adjacent to each other are respectively substituted with a hydroxyl group. Examples of the pyrogallol compound include pyrogallol, gallic acid, gallic acid esters, benzophenone derivatives such as 2,3,4-trihydroxybenzophenone and 2,2',3,4-tetrahydroxybenzophenone, and catechin derivatives such as epigallocatechin and epigallocatechin gallate. Among these pyrogallol compounds, gallic acid is preferably used from the viewpoint of a good reactivity.

The amount of the pyrogallol compound being present in the polycondensation reaction system is preferably from 0.001 to 1 part by mass, more preferably from 0.005 to 0.4 part by mass and still more preferably from 0.01 to 0.2 part by mass on the basis of 100 parts by mass of a total amount of the alcohol component and the carboxylic acid component which are subjected to the polycondensation reaction, from the viewpoint of a good reactivity. The "amount of the pyrogallol compound being present" as used herein means a total amount of the pyrogallol compound added which is subjected to the polycondensation reaction.

The mass ratio of the pyrogallol compound to the esterification catalyst (pyrogallol compound/esterification catalyst) is preferably from 0.01 to 0.5, more preferably from 0.02 to 0.3 and still more preferably from 0.03 to 0.2 from the viewpoint of a good reactivity.

The polycondensation reaction between the alcohol component and the carboxylic acid component may be carried out, for example, in the presence of the above esterification catalyst in an inert gas atmosphere at a temperature of from 120 to 250° C., preferably from 140 to 240° C., more preferably from 150 to 240° C. and still more preferably from 160 to 235° C. from the viewpoint of a good reactivity.

Also, for example, in order to increase a strength of the obtained resin, there may be used the method in which all of the monomers are charged at one time, or in order to reduce a content of low-molecular weight components in the obtained product, there may be used the method in which divalent monomers are first reacted, and then trivalent or higher-valent monomers are added and reacted, or the like. Alternatively, the pressure of the reaction system may be reduced at a rear stage of the polymerization reaction to promote the reaction.

<Method for Producing Amorphous Composite Resin (A)>

The amorphous composite resin (A) is preferably produced by any of the following methods (1) to (3). Meanwhile, the bireactive monomer is preferably fed to the reaction system together with monomers of the segment (A2) from the viewpoint of a good reactivity.

(1) Method of first carrying out a step (a) of subjecting an alcohol component and a carboxylic acid component as monomers of the segment (A1) (polycondensation-based resin component) to polycondensation reaction, and then carrying out a step (b) of subjecting monomers of the segment (A2) (addition polymerization-based resin component) and the bireactive monomer to addition polymerization reaction.

The step (b) may be followed by a step of raising the reaction temperature again and, if required, adding the monomer having a higher reactivity among the monomers of the segment (A1) (polycondensation-based resin component) to the polymerization system in order to allow the polycondensation reaction in the step (a) or the reaction with the bireactive monomer to further proceed.

Examples of the "monomer having a higher reactivity" as used herein include fumaric acid, and a trivalent or higher-valent polycarboxylic acid compound such as, for example, trimellitic anhydride.

(2) Method of first carrying out the step (b) of subjecting the monomers of the segment (A2) and the bireactive monomer to addition polymerization reaction, and then carrying out the step (a) of subjecting the monomers of the segment (A1) to polycondensation reaction.

The alcohol component and the carboxylic acid component of the segment (A1) may be allowed to be previously present in the reaction system upon the addition polymerization reaction, and upon reaching a reaction temperature suitable for the polycondensation reaction, the esterification catalyst may be added to the reaction system to initiate the polycondensation reaction between the alcohol component and the carboxylic acid component. Alternatively, the alcohol component and the carboxylic acid component of the segment (A1) may be subsequently added to the reaction system under the temperature condition suitable for the polycondensation reaction to initiate the polycondensation reaction therebetween. In the former case, since the esterification catalyst is added at the temperature suitable for the polycondensation reaction, it is possible to well control a molecular weight and a molecular weight distribution of the resulting resin.

(3) Method of carrying out the step (a) of subjecting the monomers of the segment (A1) to polycondensation reaction in parallel with the step (b) of subjecting the monomers of the segment (A2) and the bireactive monomer to addition polymerization reaction.

In this method, it is preferred that both the step (a) and the step (b) are carried out under the temperature condition suitable for the addition polymerization reaction, and then the reaction temperature is raised until reaching the temperature suitable for the polycondensation reaction and, if required, the monomer having a higher reactivity among the monomers of the segment (A1) (polycondensation-based resin component) is added to the polymerization system, to further carry out the polycondensation reaction of the step (a). In this case, under the temperature condition suitable for the polycondensation reaction, it is possible to allow the polycondensation reaction only to proceed by adding a radical polymerization inhibitor to the reaction system. The bireactive monomer is subjected to not only the addition polymerization reaction but also the polycondensation reaction.

Among the above methods, the method (2) is preferably adopted from the viewpoint of a large degree of freedom of the reaction temperature used in the polycondensation reaction.

The temperature suitable for the addition polymerization reaction is preferably not lower than 120° C. and lower than 180° C., more preferably not lower than 150° C. and lower than 170° C. and still more preferably not lower than 155° C. and lower than 165° C.

The temperature suitable for the polycondensation reaction is preferably from 180 to 250° C., more preferably from 190 to 240° C. and still more preferably from 195 to 235° C.

The methods (1) to (3) are preferably respectively carried out in the same reaction vessel.

[Process for Producing Toner for Electrophotography]

The toner for electrophotography according to the present invention can be suitably produced by the process including the following steps 1 to 3:

Step 1: preparing an aqueous dispersion of resin particles I containing the amorphous composite resin (A) which contains the segment (A1) formed of the polyester resin and the segment (A2) formed of the styrene-containing addition polymer as a constitutional unit thereof;

Step 2: mixing the aqueous dispersion of the resin particles I obtained in the step 1 with a resin aqueous dispersion containing the amorphous resin (B) obtained by polycondensing an alcohol component containing an aliphatic diol having 2 to 6 carbon atoms with a carboxylic acid component to aggregate the resin particles I and the amorphous resin (B), thereby preparing an aqueous dispersion of resin particles II; and Step 3: coalescing the resin particles II obtained in the step 2.

<Step 1>

In the step 1, an aqueous dispersion of resin particles I containing the amorphous composite resin (A) which contains the segment (A1) formed of the polyester resin and the segment (A2) formed of the styrene-containing addition polymer as a constitutional unit thereof is prepared.

Meanwhile, the term "aqueous" as used herein means that it may also contain a solvent such as an organic solvent, but preferably contains water in an amount of 50% by mass or more, more preferably 70% by mass or more, still more preferably 90% by mass more and especially preferably 99% by mass or more.

The aqueous dispersion of the resin particles I is prepared by dispersing the resins containing the amorphous composite resin (A) in an aqueous solvent. The particles constituting the resin particles I may be obtained either by simply dispersing the resins containing the amorphous composite resin (A) in the aqueous solvent or by subjecting the resin aqueous dispersion containing the amorphous composite resin (A) to aggregation step. However, the aqueous dispersion of the resin particles I is preferably obtained by subjecting the resin aqueous dispersion containing the amorphous composite resin (A) to aggregation step in the step (1) from the viewpoints of obtaining toner particles having uniform particle sizes and enhancing a low-temperature fusing property, a heat-resistant storage property and an anti-hot offset property of the resulting toner. The preferred embodiment of the step (1) in which the aqueous dispersion of the resin particles I is prepared by subjecting the resin aqueous dispersion containing the amorphous composite resin (A) which contains the segment (A1) formed of the polyester resin and the segment (A2) formed of the styrene-containing addition polymer as a constitutional unit thereof to aggregation step is described more specifically below.

(Preparation of Resin Aqueous Dispersion Containing Amorphous Composite Resin (A))

[Preparation of Resin Aqueous Dispersion Using Organic Solvent]

The aqueous dispersion of the resin particles I may be suitably obtained by mixing the amorphous composite resin (A), an organic solvent and water, if required, together with a neutralizing agent or a surfactant, stirring the resulting mixture, and then removing the organic solvent from the obtained dispersion by distillation, etc. Preferably, the amorphous composite resin (A) is first dissolved, if required, together with the surfactant, in the organic solvent, and then the resulting organic solvent solution is mixed with water and, if required, further with the neutralizing agent. The mixture of the respective components may be stirred using an optional mixing and stirring apparatus such as an anchor blade.

Examples of the organic solvent include alcohol solvents such as ethanol, isopropanol and isobutanol; ketone solvents such as acetone, methyl ethyl ketone, methyl isobutyl ketone and diethyl ketone; ether solvents such as dibutyl ether, tetrahydrofuran and dioxane; and ethyl acetate. Among these organic solvents, from the viewpoint of a good dispersion stability of the resin therein, preferred are methyl ethyl ketone and ethyl acetate, and more preferred is methyl ethyl ketone.

Examples of the neutralizing agent include hydroxides of alkali metals such as lithium hydroxide, sodium hydroxide and potassium hydroxide; and organic bases such as ammonia, trimethyl amine, ethyl amine, diethyl amine, triethyl amine, triethanol amine and tributyl amine. Among these neutralizing agents, from the viewpoints of good availability and workability, preferred is sodium hydroxide. The neutralizing agent is preferably used in an amount of from 0.1 to 10 parts by mass and more preferably from 0.5 to 8 parts by mass on the basis of 100 parts by mass of the resins in the resin aqueous dispersion containing the amorphous composite resin (A).

Examples of the surfactant include anionic surfactants such as sulfuric acid ester-based surfactants, sulfonate-based surfactants, phosphoric acid ester-based surfactants and soap-based surfactants (such as, e.g., alkyl ether carboxylic acid salts); cationic surfactants such as amine salt-type surfactants and quaternary ammonium salt-type surfactants; and nonionic surfactants, e.g., polyoxyethylene alkyl aryl ethers such as polyoxyethylene nonyl phenyl ether, polyoxyethylene alkyl ethers such as polyoxyethylene oleyl ether and polyoxyethylene lauryl ether, polyoxyethylene sorbitan esters such as polyoxyethylene sorbitan monolaurate and polyoxyethylene sorbitan monostearate, polyoxyethylene fatty acid esters such as polyethylene glycol monolaurate, polyethylene glycol monostearate and polyethylene glycol monooleate, and oxyethylene/oxypropylene block copolymers. The amount of the surfactant, if used, is preferably from 0.1 to 20 parts by mass and more preferably from 0.5 to 10 parts by mass on the basis of 100 parts by mass of the resins in the resin aqueous dispersion containing the amorphous composite resin (A) from the viewpoint of a good dispersion stability of the obtained resin.

The amount of the organic solvent to be mixed with the amorphous composite resin (A) is preferably from 100 to 1000 parts by mass and more preferably from 150 to 500 parts by mass on the basis of 100 parts by mass of the resins in the resin aqueous dispersion containing the amorphous composite resin (A) from the viewpoint of a good solubility of the resins therein. The amount of water to be mixed with the amorphous composite resin (A) is preferably from 100 to 1000 parts by mass and more preferably from 150 to 500 parts by mass on the basis of 100 parts by mass of the organic solvent from the viewpoint of a good dispersion stability of the resins therein.

The temperature used upon mixing the amorphous composite resin (A) with the organic solvent is preferably from 30 to 90° C. and more preferably from 40 to 80° C. from the viewpoint of a good solubility of the resins in the organic solvent.

The solid content of the thus obtained aqueous dispersion containing the amorphous composite resin (A) may be suitably controlled by adding an appropriate amount of water thereto, and is preferably controlled to the range of from 3 to 50% by mass, more preferably from 5 to 30% by mass and still more preferably from 7 to 15% by mass from the viewpoint of a good dispersion stability of the resins therein.

[Volume Median Particle Size]

The volume median particle size of the resin particles containing the amorphous composite resin (A) in the aqueous dispersion is preferably from 0.05 to 1 μm, more preferably from 0.05 to 0.5 μm, still more preferably from 0.05 to 0.4 μm and especially preferably from 0.1 to 0.35 μm from the viewpoint of uniformly aggregating the resin particles in the subsequent aggregating step. The volume median particle size may be measured by a laser diffraction type particle size measuring apparatus as described hereinlater, etc.

(Preparation of Resin Aqueous Dispersion Containing Crystalline Polyester)

The resin aqueous dispersion containing the crystalline polyester may also be produced by the same method as used for producing the above resin aqueous dispersion containing the amorphous composite resin (A), and the preferred ranges of the production conditions, etc., are also the same as those described for the above resin aqueous dispersion containing the amorphous composite resin (A).

(Preparation of Aqueous Dispersion of Resin Particles I (Aggregating Step))

Next, the resin aqueous dispersion containing the amorphous composite resin (A) is subjected to aggregation of the resins, if required, after mixing the resin aqueous dispersion with an aqueous dispersion of a releasing agent and/or a resin aqueous dispersion containing the crystalline polyester, to prepare the aqueous dispersion of the resin particles I.

Meanwhile, the above aggregating step may also be carried out after further adding various additives such as, for example, a colorant, a charge controlling agent, a conductivity modifier, a reinforcing filler such as fibrous substances and an antioxidant to the resin aqueous dispersion containing the amorphous composite resin (A). These additives may also be respectively used in the form of an aqueous dispersion thereof.

Further, in the aggregating step, in order to effectively carry out the aggregation step, an aggregating agent may be added thereto.

[Releasing Agent]

The amount of the releasing agent added is preferably from 0.1 to 10 parts by mass, more preferably from 0.5 to 5 parts by mass and still more preferably from 1 to 3 parts by mass on the basis of 100 parts by mass of a total amount of the resins contained in the resin aqueous dispersion containing the amorphous composite resin (A) as the core-forming resin particles from the viewpoint of a good dispersibility in the resins. The mass ratio between the releasing agent and the amorphous composite resin (A) in the core portion is the same as described above.

[Colorant]

The colorant used in the present invention is not particularly limited, and may be appropriately selected from known colorants according to the aimed applications or objects. Specific examples of the colorant include various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, Calco Oil Blue, Methylene Blue Chloride, Phthalocyanine Blue (copper phthalocyanine), Phthalocyanine Green and Malachite Green Oxalate; and various dyes such as acridine dyes, xanthene dyes, azo dyes, benzoquinone dyes, azine dyes, anthraquinone dyes, indigo dyes, thioindigo dyes, phthalocyanine dyes, Aniline Black dyes, polymethine dyes, triphenylmethane dyes, diphenylmethane dyes, thiazine dyes and thiazole dyes. These colorants may be used alone or in combination of any two or more thereof.

The amount of the colorant added is preferably from 0.1 to 20 parts by mass, more preferably from 1 to 10 parts by mass and still more preferably from 5 to 10 parts by mass on the basis of 100 parts by mass of a total amount of the resins in the resin aqueous dispersion containing the amorphous composite resin (A) from the viewpoint of improving an image quality.

[Charge Controlling Agent]

Examples of the charge controlling agent include chromium-based azo dyes, iron-based azo dyes, aluminum-based azo dyes and metal complexes of salicylic acid. Among these charge controlling agents, preferred are metal complexes of salicylic acid from the viewpoints of a good charging stability of the resulting toner as well as a good availability thereof, etc. These charge controlling agents may be used alone or in combination of any two or more thereof.

The amount of the charge controlling agent added is preferably from 0.1 to 8 parts by mass, more preferably from 0.3 to 7 parts by mass and still more preferably from 0.8 to 3 parts by mass on the basis of 100 parts by mass of a total amount of the resins in the resin aqueous dispersion containing the amorphous composite resin (A) from the viewpoint of improving an image quality.

[Crystalline Polyester]

When using the crystalline polyester, the mass ratio between the crystalline polyester and the amorphous composite resin (A) to be mixed with each other is the same as described in the above paragraph "Properties of Crystalline Polyester or the like".

[Aggregating Agent]

As the organic aggregating agent, a cationic surfactant in the form of a quaternary ammonium salt, polyethyleneimine or the like may be used, and as the inorganic aggregating agent, an inorganic metal salt, an inorganic ammonium salt, a divalent or higher-valent metal complex or the like may be used.

The inorganic metal salt includes, for example, metal salts such as sodium sulfate, sodium chloride, calcium chloride, calcium nitrate, barium chloride, magnesium chloride, zinc chloride, aluminum chloride and aluminum sulfate; and inorganic metal salt polymers such as poly(aluminum chloride), poly(aluminum hydroxide), and poly(calcium sulfide). Specific examples of the inorganic ammonium salt include ammonium sulfate, ammonium chloride and ammonium nitrate.

The amount of the aggregating agent added is preferably 60 parts by mass or less, more preferably 30 parts by mass or less and still more preferably 10 parts by mass or less, and is preferably 0.1 part by mass or more, more preferably 0.3 part by mass or more and still more preferably 0.5 part by mass or more, on the basis of 100 parts by mass of the resins in the resin aqueous dispersion containing the amorphous composite resin (A) from the viewpoint of a good environmental resistance of the resulting toner.

The aggregating agent is preferably added in the form of an aqueous solution prepared by dissolving the aggregating agent in an aqueous medium to allow a uniform aggregation of the resin particles, and the mixture obtained during and after addition of the aggregating agent is preferably sufficiently stirred.

[Various Conditions in Reaction System]

The solid content in the reaction system used in the aggregating step is preferably from 5 to 50% by mass, more preferably from 5 to 30% by mass and still more preferably from 5 to 20% by mass in view of uniformly aggregating the resin particles.

The pH value of the reaction system used in the aggregating step is preferably from 2 to 10, more preferably from 2 to 9 and still more preferably from 3 to 8 from the viewpoints of achieving both of a good dispersion stability of the mixed solution and a good aggregating property of the resin particles.

From the same viewpoints as described above, the temperature of the reaction system in the aggregating step is preferably not lower than the temperature calculated from the "softening point of the resin in the core portion −(minus) 75° C." (this means the temperature lower by 75° C. than the softening point of the resin in the core portion; hereinafter defined in the same way) and not higher than the softening point of the resin in the core portion. In the present invention, since the amorphous composite resin (A) is used as the resin in the core portion, the "softening point of the resin in the core portion" is identical to the softening point of the amorphous composite resin (A). Also, in the case where the amorphous composite resin (A) is used in combination with the crystalline polyester or the amorphous resin other than the amorphous composite resin (A), the "softening point of the resin in the core portion" is defined as a weighted mean value of softening points of the amorphous composite resin (A) and the crystalline polyester or the amorphous resin other than the amorphous composite resin (A).

In addition, the additives such as a colorant and a charge controlling agent may be previously mixed in the amorphous composite resin (A) upon preparing the resin particles I. Alternatively, the respective additives may be separately dispersed in a dispersing medium such as water to prepare respective dispersions, and the thus prepared additive dispersions may be mixed with the resin aqueous dispersion containing the amorphous composite resin (A) and then subjected to the aggregating step. When the additives are previously mixed in the amorphous composite resin (A) upon preparing the resin particles, it is preferred that the amorphous composite resin (A) and the additives are previously melt-kneaded with each other.

The melt-kneading is preferably carried out using an open roll type twin-screw kneader. The open, roll type twin-screw kneader has two rolls arranged close to and parallel with each other through which a heating medium can be flowed to impart a heating function or a cooling function thereto. Thus, since the open roll type twin-screw kneader has a melt-kneading section having an open structure and is equipped with a heating roll and a cooling roll, a kneading heat generated upon the melt-kneading can be readily released therefrom unlike the conventional twin-screw extruders.

[Dispersing Treatment]

The mixture containing the resin aqueous dispersion containing the amorphous composite resin (A), if required, together with a resin aqueous dispersion containing the resin other than the amorphous composite resin (A) such as the crystalline polyester and an aqueous dispersion containing various additives is preferably subjected to dispersing treatment at a temperature lower than the softening point of the resin in the core and more preferably at a temperature not higher than the "softening point of the resin in the core −(minus) 30° C." from the viewpoint of obtaining a uniform dispersion. More specifically, the temperature used upon the dispersing treatment is preferably 70° C. or lower and more preferably 65° C. or lower. Also, the dispersing treatment is preferably carried out at a temperature higher than 0° C., and more preferably at a temperature of 10° C. or higher from the viewpoints of maintaining a good fluidity of the medium and saving an energy required for production of the aqueous dispersion of the respective resins.

From these viewpoints, the above mixture may be dispersed by an ordinary method such as dispersing treatment with stirring at a temperature of preferably from about 0° C. to about 70° C. and more preferably from about 10° C. to about 65° C., thereby preparing a uniform resin dispersion.

The dispersing treatment may be carried out using a high-speed mixer or stirrer such as "Ultra Disper" (tradename: available from Asada Iron Works Co., Ltd.), "Ebara Milder" (tradename: available from Ebara Corp.) and "TK Homo Mixer" (tradename: available from Primix Corp.); a homo-valve-type high-pressure homogenizer such as typically "High-Pressure Homogenizer" (tradename: available from Izumi Food Machinery Co., Ltd.) and "Mini-Labo 8.311 Model" (tradename: available from Rannie Corp.); and a chamber-type high-pressure homogenizer such as "Microfluidizer" (tradename: available from Microfluidics Inc.) and "Nanomizer" (tradename: available from Nanomizer Co., Ltd.).

[Volume Median Particle Size of Resin Particles I]

The volume median particle size of the resin particles I obtained in the step 1 is preferably from 1 to 10 μm, more preferably from 2 to 8 μm and still more preferably from 3 to 7 μm from the viewpoint of uniformly coalescing the aggregated particles in the subsequent step 3 to produce toner particles.

<Step 2>

In the step 2, the aqueous dispersion of the resin particles I obtained in the step 1 is mixed with the resin aqueous dispersion containing the amorphous resin (B) obtained by polycondensing an alcohol component containing an aliphatic diol having 2 to 6 carbon atoms with a carboxylic acid component to aggregate the resin particles I and the amorphous resin (B), thereby preparing an aqueous dispersion of resin particles II.

The resin aqueous dispersion containing the amorphous resin (B) obtained by polycondensing an alcohol component containing an aliphatic diol having 2 to 6 carbon atoms with a carboxylic acid component may be prepared by the same method as used for preparing the resin aqueous dispersion containing the amorphous composite resin (A). The thus prepared resin aqueous dispersion containing the amorphous resin (B) may also contain additives such as a colorant, a releasing agent and a charge controlling agent, if required, but preferably contains no additives.

The volume median particle size of the particles contained in the resin aqueous dispersion containing the amorphous resin (B) which is to be mixed in the step 2 is preferably from 0.05 to 1 μm, more preferably from 0.05 to 0.5 μm, still more preferably from 0.05 to 0.4 μm and especially preferably from 0.1 to 0.35 μm from the viewpoint of producing uniform core-shell particles.

The amount of the amorphous resin (B) to be mixed on the basis of 100 parts by mass of the resin particles I obtained in the step 1 is preferably from 5 to 200 parts by mass, more preferably from 10 to 100 parts by mass and still more preferably from 25 to 60 parts by mass.

The mass ratio between the amorphous composite resin (A) in the resin particles I obtained in the step 1 and the amorphous resin (B) may be the same as the mass ratio between the amorphous composite resin (A) and the amorphous resin (B) as described previously.

The average particle size of the resin particles II obtained in the step 2 is controlled such that the volume median particle size thereof is preferably from 1 to 10 μm, more preferably from 2 to 8 μm and still more preferably from 3 to 7 μm from the viewpoint of uniformly coalescing the resin particles in the subsequent step 3 to produce toner particles. The aggregating conditions used in the step 2 are the same as those described in the step 1.

The resin particles II obtained in the step 2 form a precursor of the core-shell structure. That is, the resin particles I containing the amorphous composite resin (A) obtained in the step 1, if required, together with additives or the like, form a core portion, and the amorphous resin (B) added in the step 2 form a shell portion around the core portion. The amount of the thus formed shell containing the amorphous resin (B) is preferably from 10 to 120 parts by mass, more preferably from 20 to 100 parts by mass, still more preferably from 20 to 70 parts by mass and especially preferably from 25 to 50 parts by mass on the basis of 100 parts by mass of the core containing the amorphous composite resin (A) and the additives from the viewpoints of a low-temperature fusing property, a heat-resistant storage property and an anti-hot offset property of the resulting toner.

<Step 3>

In the step 3, the resin particles II obtained in the step 2 are subjected to a coalescing step.

In the step 3, the aggregated particles obtained in the step 2 may be heated to obtain unified particles thereof.

The temperature of the reaction system in the step 3 is preferably not lower than the "softening point of the resin −(minus) 55° C." and not higher than the "softening point of the resin +(plus) 10° C."; more preferably not lower than the "softening point of the resin −(minus) 50° C." and not higher than the "softening point of the resin +(plus) 10° C."; and still more preferably not lower than the "softening point of the resin −(minus) 45° C." and not higher than the "softening point of the resin +(plus) 10° C.", from the viewpoints of well controlling a particle size, a particle size distribution and a particle shape of the toner as aimed, and attaining a good fusibility of the particles. More specifically, from the same viewpoints, the temperature of the reaction system in the step 3 is preferably kept in the range of from 40 to 90° C. and more preferably from 50 to 80° C.

In addition, the stirring rate used in the step 3 is preferably a rate at which the aggregated particles are not precipitated. The "softening point of the resin" as used herein means the temperature as a weighted mean value of the softening point of the amorphous composite resin (A) and the softening point of the amorphous resin (B). When further using the crystalline polyester or the amorphous resin other than the amorphous composite resin (A) and the amorphous resin (B), the "softening point of the resin" as used herein means the temperature as a weighted mean value of the softening point of the amorphous composite resin (A), the softening point of the amorphous resin (B) and the softening point of the resin other than the resins (A) and (B).

Meanwhile, as an aggregation stopping agent which may be used in the step 3, a surfactant is preferably used. The aggregation stopping agent is more preferably an anionic surfactant from the viewpoints of good availability and handling property thereof. Among the anionic surfactants, at least one compound selected from the group consisting of alkylether sulfuric acid salts, alkyl sulfuric acid salts and straight-chain alkylbenzenesulfonic acid salts is still more preferably used.

When using the crystalline polyester, from the viewpoints of attaining both a good low-temperature fusing property and a good storage stability of the resulting toner after the coalescing and cooling step, the temperature used in the step 3 may be raised to a temperature range of from the "melting point of the crystalline polyester −(minus) 10° C." to the "melting point of the crystalline polyester −(minus) 30° C.", and from 40° C. to the "coalescing temperature −(minus) 10° C.".

The toner for electrophotography according to the present invention (hereinafter referred to merely as a "toner") may be produced by appropriately subjecting the unified particles obtained in the step 3 to a liquid-solid separation step such as filtration, a washing step and a drying step.

In the washing step, the unified particles may be washed with an acid to remove metal ions from the surface of the respective toner particles for the purpose of ensuring a sufficient charging property and a good reliability required for the resulting toner. In the washing step, the unified particles are preferably washed to such an extent that the nonionic surfactant added is also completely removed therefrom. For this reason, the unified particles are preferably washed with an aqueous solution at a temperature not higher than a cloud point of the nonionic surfactant. The washing step is preferably repeated a plurality of times.

In addition, in the drying step, any optional methods such as vibration-type fluidization drying method, spray-drying method, freeze-drying method and flash jet method may be employed. The content of water in the toner obtained after drying is preferably adjusted to 1.5% by mass or less and more preferably 1.0% by mass or less from the viewpoint of a good charging property of the resulting toner.

Further, for the purpose of improving a fluidity, etc., an external additive may be added to the thus obtained toner. As the external additive, there may be used known fine particles. Examples of the fine particles as the external additive include inorganic fine particles such as silica fine particles whose surface is subjected to a hydrophobic treatment, titanium oxide fine particles, alumina fine particles, cerium oxide fine particles and carbon blacks; and polymer fine particles such as fine particles of polycarbonates, polymethyl methacrylate, silicone resins, etc. Among these external additives, silica fine particles are preferred from the viewpoint of a good availability.

The number-average particle size of the external additive is preferably from 4 to 200 nm and more preferably from 8 to 30 nm from the viewpoint of a good fluidity of the resulting toner. The number-average particle size of the external additive may be determined using a scanning electron microscope or a transmission electron microscope.

The amount of the external additive added to the toner is preferably from 0.1 to 5 parts by mass, more preferably from 0.1 to 1 part by mass and still more preferably from 0.2 to 0.8 part by mass on the basis of 100 parts by mass of the toner before being treated with the external additive from the viewpoints of a good fluidity, a good environmental stability of charging rate and a good storage stability under load.

(Properties of Toner for Electrophotography)

The volume median particle size of the toner for electrophotography according to the present invention is preferably from 1 to 10 μm, more preferably from 2 to 8 μm and still more preferably from 3 to 7 μm from the viewpoints of a high image quality and a high productivity of the toner.

The softening point of the toner is preferably from 80 to 160° C., more preferably from 80 to 150° C. and still more preferably from 90 to 140° C. from the viewpoints of a low-temperature fusing property, a heat-resistant storage property and a charging stability of the resulting toner.

The toner for electrophotography according to the present invention may be used in the form of a one-component system developer or a tow-component system developer formed by mixing the toner with a carrier.

In the above-mentioned preferred embodiments of the present invention, there are disclosed the following aspects concerning the toner for electrophotography and the process for producing the toner.

<1> A toner for electrophotography including core-shell particles each including a core containing a amorphous composite resin (A) which contains a segment (A1) formed of a polyester resin and a segment (A2) formed of a styrene-containing addition polymer as a constitutional unit thereof and a shell containing a amorphous resin (B) obtained by polycondensing an alcohol component containing an aliphatic diol having 2 to 6 carbon atoms with a carboxylic acid component.

<2> The toner for electrophotography as described in the above aspect <1>, wherein a mass ratio of the segment (A1) formed of the polyester resin to the segment (A2) formed of the styrene-containing addition polymer as a constitutional unit thereof [(A1)/(A2)] in the amorphous composite resin (A) is from 50/50 to 95/5, preferably from 65/35 to 90/10, more preferably from 60/40 to 80/20 and still more preferably from 65/35 to 75/25.

<3> The toner for electrophotography as described in the above aspect <1> or <2>, wherein the amorphous composite resin (A) has a softening point of from 80 to 150° C., preferably from 85 to 130° C. and more preferably from 90 to 120° C.

<4> The toner for electrophotography as described in any one of the above aspects <1> to <3>, wherein the amorphous resin (B) is contained in an amount of from 10 to 120 parts by mass, preferably from 20 to 100 parts by mass, more preferably from 20 to 70 parts by mass, still more preferably from 20 to 50 parts by mass and especially preferably from 25 to 40 parts by mass on the basis of 100 parts by mass of the amorphous composite resin (A).

<5> The toner for electrophotography as described in any one of the above aspects <1> to <4>, wherein the core contains a releasing agent.

<6> The toner for electrophotography as described in any one of the above aspects <1> to <5>, wherein an alcohol component of the segment (A1) is at least one compound selected from the group consisting of an aromatic diol, an aliphatic diol and a trivalent or higher-valent polyhydric alcohol, preferably contains an aromatic diol, more preferably is constituted of an aromatic diol, and still more preferably is constituted of a compound represented by the above general formula (I).

<7> The toner for electrophotography as described in any one of the above aspects <1> to <6>, wherein the alcohol component of the segment (A1) is constituted of the compound represented by the above general formula (I) in which an average value of a sum of x and y is preferably from 1 to 16, more preferably from 1 to 8 and still more preferably from 1.5 to 4; the sum of x and y is preferably from 1 to 16, more preferably from 1 to 8 and still more preferably from 2 to 4; and a plurality of $R^aO$ groups in the number of x and a plurality of $R^bO$ groups in the number of y are respectively an ethyleneoxy group or a propyleneoxy group.

<8> The toner for electrophotography as described in any one of the above aspects <1> to <7>, wherein the alcohol component of the segment (A1) is an alkyleneoxide adduct of 2,2-bis(4-hydroxyphenyl)propane and preferably a mixture of a propyleneoxide adduct of 2,2-bis(4-hydroxyphenyl)propane and an ethyleneoxide adduct of 2,2-bis(4-hydroxyphenyl)propane.

<9> The toner for electrophotography as described in any one of the above aspects <1> to <8>, wherein the alcohol component of the segment (A1) is a mixture of a propyleneoxide adduct of 2,2-bis(4-hydroxyphenyl)propane and an ethyleneoxide adduct of 2,2-bis(4-hydroxyphenyl)propane in which a mixing molar ratio of the propyleneoxide adduct of 2,2-bis(4-hydroxyphenyl)propane to the ethyleneoxide adduct of 2,2-bis(4-hydroxyphenyl)propane is preferably from 50/50 to 99/1, more preferably from 60/40 to 80/20 and still more preferably from 65/35 to 75/25.

<10> The toner for electrophotography as described in any one of the above aspects <1> to <9>, wherein a content of the alkyleneoxide adduct of 2,2-bis(4-hydroxyphenyl)propane in the alcohol component of the segment (A1) is preferably 50 mol % or more, more preferably 70 mol % or more, still more preferably 80 mol % or more and especially preferably substantially 100 mol %.

<11> The toner for electrophotography as described in any one of the above aspects <1> to <10>, wherein a carboxylic acid component of the segment (A1) contains an aromatic dicarboxylic acid compound, and a content of the aromatic dicarboxylic acid compound in the carboxylic acid component of the segment (A1) is preferably from 30 to 95 mol %, more preferably from 50 to 90 mol %, still more preferably from 53 to 85 mol % and especially preferably from 55 to 83 mol %.

<12> The toner for electrophotography as described in any one of the above aspects <1> to <11>, wherein a carboxylic acid component of the segment (A1) contains an aromatic dicarboxylic acid compound, and a content of the aromatic dicarboxylic acid compound in the carboxylic acid component of the segment (A1) is preferably from 30 to 95 mol %, more preferably from 50 to 90 mol %, still more preferably from 53 to 85 mol % and especially preferably from 55 to 83 mol %.

<13> The toner for electrophotography as described in any one of the above aspects <1> to <12>, wherein the carboxylic acid component of the segment (A1) contains a trivalent or higher-valent polycarboxylic acid compound, preferably a trimellitic acid compound and more preferably trimellitic anhydride, and a content of the trivalent or higher-valent polycarboxylic acid compound in the carboxylic acid component of the segment (A1) is preferably from 0.1 to 30 mol %, more preferably from 1 to 30 mol %, still more preferably from 10 to 30 mol % and especially preferably from 15 to 25 mol %.

<14> The toner for electrophotography as described in any one of the above aspects <1> to <13>, wherein a molar ratio of the carboxylic acid component to the alcohol component (carboxylic acid component/alcohol component) in the segment (A1) constituting the amorphous composite resin (A) is preferably from 0.60 to 1.2, more preferably from 0.65 to 1.0 and still more preferably from 0.70 to 0.90.

<15> The toner for electrophotography as described in any one of the above aspects <1> to <14>, wherein combination of the alcohol component and the carboxylic acid component in the segment (A1) is combination of the compound represented by the general formula (I) and terephthalic acid and preferably combination of the compound represented by the general formula (I), terephthalic acid and trimellitic anhydride.

<16> The toner for electrophotography as described in any one of the above aspects <1> to <15>, wherein combination of the alcohol component and the carboxylic acid component in the segment (A1) is combination of the compound represented by the general formula (I), terephthalic acid, trimellitic anhydride and an alkenyl succinic acid.

<17> The toner for electrophotography as described in any one of the above aspects <1> to <16>, wherein combination of the alcohol component and the carboxylic acid component in the segment (A1) is combination of the compound represented by the general formula (I), terephthalic acid and fumaric acid.

<18> The toner for electrophotography as described in any one of the above aspects <1> to <17>, wherein a monomer forming a constitutional unit of the segment (A2) contains styrene solely or combination of styrene and a (meth) acrylic acid ester, and preferably combination of styrene and a (meth)acrylic acid ester.

<19> The toner for electrophotography as described in any one of the above aspects <1> to <18>, wherein a content of the styrene-containing addition polymer as a constitutional unit in the segment (A2) is preferably from 60 to 100% by mass, more preferably from 80 to 100% by mass, still more preferably from 90 to 100% by mass, and especially preferably substantially 100% by mass.

<20> The toner for electrophotography as described in any one of the above aspects <1> to <19>, wherein the segment (A2) contains a (meth)acrylic acid ester, and the (meth) acrylic acid ester is an alkyl(meth)acrylate containing an alkyl group having 1 to 18 carbon atoms, preferably an alkyl(meth)acrylate containing an alkyl group having 4 to 12 carbon atoms, more preferably an alkyl(meth)acrylate containing an alkyl group having 8 to 12 carbon atoms, and still more preferably 2-ethylhexyl acrylate.

<21> The toner for electrophotography as described in any one of the above aspects <1> to <20>, wherein the segment (A2) contains a (meth)acrylic acid ester, and a content of a constitutional unit derived from the (meth)acrylic acid ester in the segment (A2) is preferably from 5 to 40% by mass, more preferably from 10 to 30% by mass, still more preferably from 15 to 25% by mass, and especially preferably from 15 to 20% by mass.

<22> The toner for electrophotography as described in any one of the above aspects <1> to <21>, wherein the segment (A2) contains a bireactive monomer, and the bireactive monomer is preferably at least one compound selected from the group consisting of acrylic acid and methacrylic acid and more preferably acrylic acid.

<23> The toner for electrophotography as described in any one of the above aspects <1> to <22>, wherein the segment (A2) contains a bireactive monomer, and the bireactive monomer is preferably used in an amount of from 1 to 40 mol parts, more preferably from 5 to 30 mol parts, still more preferably from 5 to 20 mol parts and especially preferably from 10 to 16 mol parts on the basis of 100 mol parts of a total amount of the carboxylic acid component as a monomer of the polyester resin contained in the segment (A1).

<24> The toner for electrophotography as described in any one of the above aspects <1> to <23>, wherein the amorphous composite resin (A) has a weight-average molecular weight of from 1,500 to 50,000, preferably from 5,000 to 45,000, more preferably from 10,000 to 43,000, and still more preferably from 15,000 to 40,000.

<25> The toner for electrophotography as described in any one of the above aspects <1> to <24>, wherein the amorphous composite resin (A) has a number-average molecular weight of from 800 to 7,000, preferably from 1,000 to 5,000, more preferably from 2,000 to 4,000, and still more preferably from 2,500 to 3,500.

<26> The toner for electrophotography as described in any one of the above aspects <1> to <25>, wherein the amorphous composite resin (A) has an acid value of from 5 to 40 mg KOH/g, preferably from 10 to 30 mg KOH/g and still more preferably from 20 to 25 mg KOH/g.

<27> The toner for electrophotography as described in any one of the above aspects <1> to <26>, wherein the amorphous composite resin (A) has a softening point of from 80 to 150° C., preferably from 85 to 130° C. and more preferably from 90 to 120° C.

<28> The toner for electrophotography as described in any one of the above aspects <1> to <27>, wherein the amorphous composite resin (A) has a glass transition temperature of from 40 to 80° C., preferably from 45 to 70° C. and more preferably from 50 to 60° C.

<29> The toner for electrophotography as described in any one of the above aspects <1> to <28>, wherein the segment (A2) is preferably contained in an amount of from 5 to 50% by mass, more preferably from 10 to 45% by mass, still more preferably from 20 to 40% by mass and especially preferably from 25 to 35% by mass on the basis of a total amount of the segment (A1) and the segment (A2).

<30> The toner for electrophotography as described in any one of the above aspects <1> to <29>, wherein a total amount of the segment (A1) and the segment (A2) contained in the amorphous composite resin (A) is preferably from 60 to 100% by mass, more preferably from 80 to 100% by mass, still more preferably from 90 to 100% by mass, and especially preferably substantially 100% by mass.

<31> The toner for electrophotography as described in any one of the above aspects <1> to <30>, wherein the alcohol component as a monomer of the amorphous resin (B) contains an aliphatic diol having 2 to 6 carbon atoms, preferably is the aliphatic diol having 2 to 6 carbon atoms, more preferably is at least one compound selected from the group consisting of 2,3-butanediol, 1,2-propanediol, neopentyl glycol and ethylene glycol, and still more preferably is 1,2-propanediol.

<32> The toner for electrophotography as described in any one of the above aspects <1> to <31>, wherein a content of the aliphatic diol having 2 to 6 carbon atoms in the alcohol component as the monomer of the amorphous resin (B) is preferably from 80 to 100 mol %, more preferably from 90 to 100 mol %, still more preferably from 95 to 100 mol %, and especially preferably substantially 100 mol %.

<33> The toner for electrophotography as described in any one of the above aspects <1> to <32>, wherein the carboxylic acid component of the amorphous resin (B) is at least one compound selected from the group consisting of fumaric acid, an alkenyl succinic anhydride, phthalic acid, isophthalic acid and terephthalic acid, preferably at least one compound selected from the group consisting of fumaric acid, an alkenyl succinic anhydride, isophthalic acid and terephthalic acid, more preferably at least one compound selected from the group consisting of isophthalic acid and terephthalic acid, and still more preferably terephthalic acid, and a content of the carboxylic acid component in the amorphous resin (B) is preferably from 30 to 95 mol %, more preferably from 50 to 90 mol %, still more preferably from 55 to 85 mol %, further still more preferably from 60 to 85 mol %, further still more preferably from 70 to 85 mol %, and especially preferably from 75 to 85 mol %.

<34> The toner for electrophotography as described in any one of the above aspects <1> to <33>, wherein the carboxylic acid component of the amorphous resin (B) contains 1,2,4-benzenetricarboxylic acid (trimellitic acid), and a content of the 1,2,4-benzenetricarboxylic acid in the carboxylic acid component of the amorphous resin (B) is preferably from 0.1 to 30 mol %, more preferably from 1 to 25 mol %, still more preferably from 10 to 20 mol % and especially preferably from 15 to 20 mol %.

<35> The toner for electrophotography as described in any one of the above aspects <1> to <34>, wherein a molar ratio of the carboxylic acid component to the alcohol component (carboxylic acid component/alcohol component) in the amorphous resin (B) is preferably from 0.7 to 1.2, more preferably from 0.7 to 1.1 and still more preferably from 0.75 to 1.0.

<36> The toner for electrophotography as described in any one of the above aspects <1> to <35>, wherein a content of the amorphous resin (B) in the shell is preferably from 60 to 100% by mass, more preferably from 80 to 100% by mass, still more preferably from 90 to 100% by mass, and especially preferably substantially 100% by mass.

<37> The toner for electrophotography as described in any one of the above aspects <1> to <36>, wherein a content of the amorphous resin (B) on the basis of a total amount of resins contained in the core-shell particles is preferably from 10 to 54 parts by mass, more preferably from 17 to 50 parts by mass, still more preferably from 17 to 41 parts by mass, and especially preferably from 17 to 33 parts by mass.

<38> The toner for electrophotography as described in any one of the above aspects <1> to <37>, wherein a content of the amorphous resin (B) on the basis of 100 parts by mass of the amorphous composite resin (A) is from 10 to 120 parts by mass, preferably from 20 to 100 parts by mass, more preferably from 20 to 70 parts by mass, still more preferably from 20 to 50 parts by mass, further still more preferably from 25 to 40 parts by mass, and especially preferably from 25 to 35 parts by mass.

<39> A process for producing the toner for electrophotography including core-shell particles as described in any one of the above aspects <1> to <38>, said process including the following steps 1 to 3:

Step 1: preparing an aqueous dispersion of resin particles I containing the amorphous composite resin (A) containing the segment (A1) formed of the polyester resin and the segment (A2) formed of the styrene-containing addition polymer as a constitutional unit thereof;

Step 2: mixing the aqueous dispersion of the resin particles I obtained in the step 1 with a resin aqueous dispersion containing the amorphous resin (B) obtained by polycondensing an alcohol component containing an aliphatic diol having 2 to 6 carbon atoms with a carboxylic acid component to aggregate the resin particles I and the amorphous resin (B), thereby preparing an aqueous dispersion of resin particles II; and Step 3: coalescing the resin particles II obtained in the step 2.

<40> The process for producing the toner for electrophotography as described in the above aspect <39>, wherein in the step 1, the aqueous dispersion of the resin particles I is prepared by subjecting a resin aqueous dispersion containing the amorphous composite resin (A) to aggregation step.

<41> The process for producing the toner for electrophotography as described in the above aspect <39>, wherein in the step 1, the aqueous dispersion of the resin particles I is prepared by aggregating resin particles containing the amorphous composite resin (A) and a releasing agent.

<42> The toner for electrophotography as described in any one of the above aspects <1> to <38>, wherein a content of the trivalent or higher-valent polycarboxylic acid compound in the carboxylic acid component of the amorphous resin (B) is from 0.1 to 30 mol %.

<43> The toner for electrophotography as described in any one of the above aspects <1> to <38> or <42>, wherein the segment (A2) contains the bireactive monomer serving as a bonding site to the segment (A1).

EXAMPLES

Various properties of the resins, etc., were measured by the following methods.

<Softening Point of Resin>

Using a flow tester (tradename: "CFT-500D" available from Shimadzu Corp.), 1 g of a sample was extruded through a nozzle having a die pore size of 1 mm and a length of 1 mm while heating the sample at a temperature rise rate of 6° C./min and applying a load of 1.96 MPa thereto with a plunger of the flow tester. The softening point of the sample was determined as the temperature at which a half amount of the sample was flowed out when plotting a downward movement of the plunger of the flow tester relative to temperature.

<Endothermic Maximum Peak Temperature and Melting Point of Resin>

Using a differential scanning calorimeter (tradename: "Q-100" available from T.A. Instruments, Japan, Inc.), a sample was cooled from room temperature (20° C.) to 0° C. at a temperature drop rate of 10° C./min, allowed to stand as such at 0° C. for 1 min, and then heated up to 180° C. at a temperature rise rate of 10° C./min to measure an endothermic curve thereof. The temperature of the peak present on the highest temperature side among the endothermic peaks observed in the curve was determined as the endothermic maximum peak temperature. If the difference between the maximum peak temperature and the softening point was within 20° C., the maximum peak temperature was determined as a melting point of the crystalline polyester.

<Glass Transition Temperature of Amorphous Resin>

Using a differential scanning calorimeter (tradename: "Q-100" available from T.A. Instruments, Japan, Inc.), a sample was weighed in an amount of from 0.01 to 0.02 g on an aluminum pan, heated to 200° C., cooled from 200° C. to 0° C. at a temperature drop rate of 10° C./min, and then heated again to 150° C. at a temperature rise rate of 10° C./min to measure an endothermic curve thereof. The glass transition temperature of the sample was determined from the endothermic curve by reading out the temperature at which an extension of a base line below the endothermic maximum peak temperature intersects a tangential line having a maximum inclination in a region from a raise-up portion to an apex of the peak in the curve.

<Acid Value of Resin>

The acid value of the resin was determined by the method according to JIS K 0070. However, only with respect to the solvent for the measurement, the mixed solvent of ethanol and ether as prescribed in JIS K 0070 was replaced with a mixed solvent containing acetone and toluene at a volume ratio of 1:1.

<Number-Average Molecular Weight and Weight-Average Molecular Weight of Resin>

The number-average molecular weight and the weight-average molecular weight of the resin were calculated from the molecular weight distribution measured by gel permeation chromatography (GPC) according to the following method.

(1) Preparation of Sample Solution

A sample was dissolved in tetrahydrofuran at 25° C. to prepare a solution having a concentration of 0.5 g/100 mL. The resultant solution was then filtered through a fluororesin filter (tradename: "DISMIC-25JP" commercially available from Advantec Co., Ltd.) having a pore size of 0.2 μm to remove insoluble components therefrom, thereby preparing a sample solution. The measurement for the crystalline polyester C-1 was conducted in the same manner as described above except for replacing tetrahydrofuran with chloroform.

(2) Measurement of Molecular Weight

Using the below-mentioned analyzer and column, tetrahydrofuran as an eluent was allowed to flow through the column at a flow rate of 1 mL/min, and the column was stabilized in a thermostat at 40° C. One hundred microliters of the sample solution were injected into the column to measure a molecular weight distribution of the sample. The molecular weight of the sample was calculated on the basis of a calibration curve previously prepared. The calibration curve of the molecular weight was prepared by using several kinds of monodisperse polystyrenes ["A-500" ($5.0\times10^2$), "A-1000" ($1.01\times10^3$), "A-2500" ($2.63\times10^4$), "A-5000" ($5.97\times10^3$), "F-1" ($1.02\times10^4$), "F-2" ($1.81\times10^4$), "F-4" ($3.97\times10^4$), "F-10" ($9.64\times10^4$), "F-20" ($1.90\times10^5$), "F-40" ($4.27\times10^5$), "F-80" ($7.06\times10^5$) and "F-128" ($1.09\times10^6$) all available from Tosoh Corporation] as reference standard samples.

Analyzer: "HLC-8220GPC" (commercially available from Tosoh Corp.)

Column: $GMH_{XL}$+$G3000H_{XL}$, (both commercially available from Tosoh Corp.)

<Volume Median Particle Sizes ($D_{50}$) of Resin Particles, Colorant Fine Particles, Releasing Agent Fine Particles and Charge Controlling Agent Fine Particles>

Using a laser diffraction particle size analyzer (tradename: "LA-920" commercially available from Horiba Seisakusho Co., Ltd.), a cell for the measurement was filled with distilled water, and a volume median particle size ($D_{50}$) of the particles was measured at a concentration at which an absorbance thereof was within an adequate range.

Production Example 1

(Production of Alkylene Compound A)

A propylene tetramer (tradename "Light Tetramer" available from Shin-Nippon Oil Corp.) was subjected to fractional distillation under heating at a temperature of from 183 to 208° C. to obtain an alkylene compound A. As a result of subjecting the thus obtained alkylene compound A to the below-mentioned gas chromatography-mass spectrometry, it was confirmed that 40 peaks were observed in a characteristic curve thereof. The results of distribution analysis of the alkylene compound A were as follows: $C_9H_{18}$: 0.5% by mass; $C_{10}H_{20}$: 4% by mass; $C_{11}H_{22}$: 20% by mass; $C_{12}H_{24}$: 66% by mass; $C_{13}H_{26}$: 9% by mass; $C_{14}H_{28}$: 0.5% by mass.

[Analysis of Alkylene Compound A by Gas Chromatography-Mass Spectrometry]

A gas chromatograph mass spectrometer (GC/MS) was mounted with a CI ion source and the following analyzing column, and subjected to start-up operation. Meanwhile, the analyzer was tuned after the elapse of 24 h from initiation of evacuation work of a MS section while flowing a CI reaction gas (methane) therethrough.

(1) GC

Gas chromatograph: "HP6890N" (tradename) available from Agilent Technologies Inc.

Column: "Ultra 1" (tradename; column length: 50 m; inner diameter: 0.2 mm; membrane thickness: 0.33 μm) available from HP Co.

GC oven heating conditions:

Initial temperature: 100° C. (0 min)

First stage temperature rise rate: 1° C./min (up to 150° C.)

Second stage temperature rise rate: 10° C./min (up to 300° C.)

Final temperature: 300° C. (10 min)

Amount of Sample Injected: 1 μL

Injection port conditions:

Injection mode: Split method

Split ratio: 50:1

Injection port temperature: 300° C.

Carrier gas:

Gas: Helium

Flow rate: 1 mL/min (constant flow rate mode)

(2) Detector

Mass spectrometer: "5973N MSD" (tradename) available from Agilent Technologies Inc.

Ionization method: Chemical ionization method

Reaction gas: Isobutane

Temperatures set:

Quadrupole: 150° C.

Ion source: 250° C.

Detection conditions: scanning

Scanning range: m/z 75 to 300

ON time of detector: 5 min

Calibration (mass calibration and sensitivity adjustment):

Reaction gas: Methane

Calibrant: PFDTD (perfluoro-5,8-dimethyl-3,6,9-trioxydodecane)

Tuning method: Auto-tuning (3) Preparation of Sample

A propylene tetramer was dissolved in isopropyl alcohol to prepare a sample solution having a propylene tetramer concentration of 5% by mass.

(Data Processing Method)

Respective alkene components having 9 to 14 carbon atoms were subjected to extraction of mass chromatograms based on mass numbers corresponding to the respective molecular ions. The extracted mass chromatograms were integrated under the integration conditions for each component as shown in Tables 2 to 5 below and under the condition of S/N (signal/noise ratio)>3. From the detection results as shown in Table 1, the proportion of specific alkyl chain length components is calculated according to the following formula.

Proportion of specific alkyl chain length components (%)=(Sum of integrated values of specific alkyl chain length components)/(Sum of integrated values of alkenes having 9 to 14 carbon atoms)×100

TABLE 1

| | Molecular weight (Mw) | Molecular ion (M/Z) | Monitor mass range (M/Z-M/Z) |
|---|---|---|---|
| $C_9H_{18}$ | 126 | 127 | 126.70-127.70 |
| $C_{10}H_{20}$ | 140 | 141 | 140.70-141.70 |
| $C_{11}H_{22}$ | 154 | 155 | 154.70-155.70 |
| $C_{12}H_{24}$ | 168 | 169 | 168.70-169.70 |
| $C_{13}H_{26}$ | 182 | 183 | 182.70-183.70 |
| $C_{14}H_{28}$ | 196 | 197 | 196.70-197.70 |

(4) Integration Conditions

Component: $C_9H_{18}$

TABLE 2

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 5.0 | Initial |
| Peak Width | 2.000 | 5.000 |

Component: $C_{10}H_{20}$

TABLE 3

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 7.0 | Initial |
| Peak Width | 2.000 | 5.000 |

Components: $C_{11}H_{22}$, $C_{12}H_{24}$ and $C_{13}H_{26}$

TABLE 4

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 7.0 | Initial |
| Peak Width | 2.000 | 5.000 |

Components: $C_{14}H_{28}$

TABLE 5

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 5.0 | Initial |
| Peak Width | 2.000 | 11.000 |

In the present invention, the alkylene compounds having 9 to 14 carbon atoms mean those compounds having peaks corresponding to respective molecular ions as measured by gas chromatography/mass spectrometry.

Production Example 2

(Production of Alkenyl Succinic Anhydride A)

A 1 L autoclave available from Nitto Koatsu Co., Ltd., was charged with 542.4 g of the alkylene compound A, 157.2 g of maleic anhydride, 0.4 g of an antioxidant "Chelex-O" (tri-isooctyl phosphite; available from SC Organic Chemical Co., Ltd.) and 0.1 g of butyl hydroquinone as a polymerization inhibitor, and an interior of the autoclave was purged with pressurized nitrogen (0.2 MPaG), and the purging procedure was repeated three times. After stirring was initiated at 60° C., the contents of the autoclave were heated up to 230° C. over 1 h, and then reacted with each other at 230° C. for 6 h. The pressure upon reaching the reaction temperature was 0.3 MPaG. After completion of the reaction, the resulting reaction solution was cooled to 80° C., and after the pressure of the reaction system was returned to a normal pressure (101.3 kPa), the reaction solution was transferred into a 1 L four-necked flask. The reaction solution in the flask was heated to 180° C. while stirring, and the residual alkylene compound was distilled off therefrom under a pressure of 1.3 kPa over 1 h. Successively, the reaction solution was cooled to room temperature (25° C.), and then the pressure within the flask was returned to a normal pressure (101.3 kPa), thereby obtaining 406.1 g of an alkenyl succinic anhydride A as the aimed product. The average molecular weight of the alkenyl succinic anhydride A as calculated from an acid value thereof was 268.

Production Examples 3 to 6 and 11

<Production of Amorphous Composite Resins A-1 to A-4 and A-8>

The monomers of a polyester (segment (A1)) except for trimellitic anhydride as shown in Table 6 were charged into a 5 L four-necked flask equipped with a dehydration tube having a nitrogen inlet tube, a stirrer and a thermocouple. In a nitrogen atmosphere, the contents of the flask were heated to 160° C., and then a mixture containing acrylic acid (as a bireactive monomer), monomers of a vinyl-based resin (segment (A2)) and a polymerization initiator was added dropwise into the flask through a dropping funnel over 1 h. After completion of the dropwise addition, the contents of the flask were subjected to addition polymerization reaction and aging for 1 h while being maintained at 160° C., and then heated to 200° C. Then, an esterification catalyst (tin (II) 2-ethyl hexanoate) and gallic acid were added to the flask, and the contents of the flask were subjected to polycondensation reaction at 230° C. for 10 h, followed by further conducting the reaction at 230° C. under a pressure of 8.0 kPa for 1 h. After the resulting reaction solution was cooled to 210° C., trimellitic anhydride was added thereto, and the obtained mixture was reacted for 1 h. The obtained reaction mixture was reacted at 210° C. under a pressure of 10 kPa until reaching a desired softening point, thereby obtaining amorphous composite resins A1 to A-4 and A-8. Properties of the thus obtained polymers are shown in Table 6.

Production Example 7

<Production of Amorphous Composite Resin A-5>

The monomers of a polyester (segment (A1)) except for fumaric acid as shown in Table 6 were charged into a 5 L four-necked flask equipped with a dehydration tube having a nitrogen inlet tube, a stirrer and a thermocouple. In a nitrogen atmosphere, the contents of the flask were heated to 160° C., and then a mixture containing acrylic acid (as a bireactive monomer), monomers of a vinyl-based resin (segment (A2)) and a polymerization initiator was added dropwise into the flask through a dropping funnel over 1 h. After completion of the dropwise addition, the contents of the flask were subjected to addition polymerization reaction and aging for 1 h while being maintained at 160° C., and then heated to 200° C. Then, an esterification catalyst and gallic acid were added to the flask, and the contents of the flask were subjected to polycondensation reaction at 230° C. for 10 h, followed by further conducting the reaction at 230° C. under a pressure of 8.0 kPa for 1 h. After the resulting reaction solution was cooled to 180° C., fumaric acid and a polymerization inhibitor were added thereto, and the obtained mixture was heated from 180° C. to 210° C. at a temperature rise rate of 10° C./min, and reacted at 210° C. for 1 h. The obtained reaction mixture was further reacted at 210° C. under a pressure of 10 kPa until reaching a softening point of 94.1° C., thereby obtaining a amorphous composite resin A-5. Properties of the thus obtained polymer are shown in Table 6.

Production Example 8

<Production of Amorphous Resin A-6>

The polyester monomers except for trimellitic anhydride, esterification catalyst and gallic acid as shown in Table 6 were charged into a 5 L four-necked flask equipped with a dehydration tube having a nitrogen inlet tube, a stirrer and a thermocouple. In a nitrogen atmosphere, the contents of the flask were subjected to polycondensation reaction at 230° C. for 10 h, followed by further conducting the reaction at 230° C. under a pressure of 8.0 kPa for 1 h. Further, the resulting reaction mixture was reacted with trimellitic anhydride at 210° C. for 1 h, and the reaction was further continued under a pressure of 10 kPa until reaching a softening point of 106.4° C., thereby obtaining a amorphous resin A-6. Properties of the thus obtained polymer are shown in Table 6.

Production Example 9

<Production of Crystalline Polyester C-1>

The polyester monomers, esterification catalyst and polymerization inhibitor as shown in Table 6 were charged into a 5 L four-necked flask equipped with a nitrogen inlet tube, a dehydration tube, a stirrer and a thermocouple. The contents of the flask were reacted at 140° C. over 5 h and then further reacted while heating to 200° C. at a temperature rise rate of 10° C./h. The reaction was continued at 200° C. until reaching a reaction rate of 80%. Thereafter, an esterification catalyst was added to the obtained reaction solution, and the resulting mixture was reacted at 200° C. for 2 h and further reacted under a pressure of 8 kPa for 2 h, thereby obtaining a crystalline polyester C-1. Properties of the thus obtained crystalline polyester are shown in Table 6.

Production Examples 10, 12 and 13

<Production of Amorphous Resins A-7, B-1 and B-2>

The polyester monomers except for trimellitic anhydride, esterification catalyst and gallic acid as shown in Table 7 were charged into a 5 L four-necked flask equipped with a nitrogen inlet tube, a dehydration tube having a fractional distillation tube through which a hot water at 100° C. was flowed, a stirrer and a thermocouple. In a nitrogen atmosphere, the contents of the flask were held at 180° C. for 1 h and then heated from 180° C. to 230° C. at a temperature rise rate of 10° C./h, and thereafter subjected to polycondensation reaction at 230° C. for 10 h, followed by further conducting the reaction at 230°

C. under a pressure of 8.0 kPa for 1 h. Further, the resulting reaction mixture was reacted with trimellitic anhydride at 210° C. for 1 h, and the reaction was further continued under a pressure of 10 kPa until reaching a desired softening point, thereby obtaining amorphous resins A-7, B-1 and B-2. Properties of the thus obtained resins are shown in Tables 6 and 7.

Production Example 14

<Production of Amorphous Resin B-3>

The polyester monomers except for fumaric acid, esterification catalyst and gallic acid as shown in Table 7 were charged into a 5 L four-necked flask equipped with a nitrogen inlet tube, a dehydration tube having a fractional distillation tube through which a hot water at 100° C. was flowed, a stirrer and a thermocouple. In a nitrogen atmosphere, the contents of the flask were held at 180° C. for 1 h and then heated from 180° C. to 230° C. at a temperature rise rate of 10° C./h, and thereafter subjected to polycondensation reaction at 230° C. for 10 h, followed by further conducting the reaction at 230° C. under a pressure of 8.0 kPa for 1 h. The resulting reaction mixture was cooled to 180° C., and then fumaric acid and a polymerization inhibitor (tert-butyl catechol) were added thereto. The obtained reaction mixture was heated from 180 to 210° C. at a temperature rise rate of 10° C./h and reacted at 210° C. for 1 h, and further the reaction was conducted at 210° C. under a pressure of 10 kPa until reaching a softening point of 99.6° C., thereby obtaining a amorphous resin B-3. Properties of the thus obtained resin are shown in Table 7.

Production Examples 15, 16 and 18

<Production of Amorphous Resins B-4, B-5 and B-7>

The same procedure as in Production Examples 12 and 13 was repeated except that formulation of the respective components was changed as shown in Table 7, thereby obtaining amorphous resins B-4, B-5 and B-7. Properties of the thus obtained resins are shown in Table 7.

Production Example 17

<Production of Amorphous Resin B-6>

The polyester monomers except for trimellitic anhydride, esterification catalyst and gallic acid as shown in Table 7 were charged into a 5 L four-necked flask equipped with a dehydration tube having a nitrogen inlet tube, a stirrer and a thermocouple. In a nitrogen atmosphere, the contents of the flask were subjected to polycondensation reaction at 230° C. for 101a, followed by further conducting the reaction at 230° C. under a pressure of 8.0 kPa for 1 h. Next, the resulting reaction mixture was reacted with trimellitic anhydride at 210° C. for 1 h, and the reaction was further continued under a pressure of 10 kPa until reaching a softening point of 116.8° C., thereby obtaining a amorphous resins B-6. Properties of the thus obtained resin are shown in Table 7.

TABLE 6

| | Core | | | | | | | | | |
|---|---|---|---|---|---|---|---|---|---|---|
| | Production Example 3 | | Production Example 4 | | Production Example 5 | | Production Example 6 | | Production Example 7 | |
| | Resin | | | | | | | | | |
| | A-1 | | A-2 | | A-3 | | A-4 | | A-5 | |
| | Amount charged (g) | Molar ratio[1)] | Amount charged (g) | Molar ratio[1)] | Amount charged (g) | Molar ratio[1)] | Amount charged (g) | Molar ratio[1)] | Amount charged (g) | Molar ratio[1)] |
| Monomers of polyester (segment (A1)) (Alcohol component) | | | | | | | | | | |
| Bisphenol A-PO adduct | 1715 | 70 | 1715 | 70 | 1225 | 70 | 1470 | 70 | 1715 | 70 |
| Bisphenol A-EO adduct | 682.5 | 30 | 682.5 | 30 | 487.5 | 30 | 585 | 30 | 682.5 | 30 |
| 1,6-Hexanediol | | | | | | | | | | |
| 1,2-Propanediol | | | | | | | | | | |
| (Acid component) | | | | | | | | | | |
| Fumaric acid | | | | | | | | | 243.6 | 30 |
| Alkenyl succinic anhydride | | | | | | | 241.2 | 15 | | |
| Terephthalic acid | 697.2 | 60 | 697.2 | 60 | 498 | 60 | 498 | 50 | 697.2 | 60 |
| Trimellitic anhydride | 201.6 | 15 | 268.8 | 20 | 144 | 15 | 230.4 | 20 | | |
| Catalyst: Tin (II) 2-ethyl hexanoate | 17.0 | 0.5 | 17.0 | 0.5 | 12.0 | 0.5 | 15.0 | 0.5 | 17.0 | 0.5 |
| Co-catalyst: Gallic acid | 1.7 | 0.05 | 1.7 | 0.05 | 1.2 | 0.05 | 1.5 | 0.05 | 1.7 | 0.05 |
| Polymerization initiator: Dibutyl peroxide | 114.5 | 8 | 68.0 | 8 | 128.4 | 8 | 104.8 | 8 | 115.94 | 8 |
| Polymerization inhibitor: Tert-butyl catechol | — | — | — | — | — | — | — | — | 1.7 | 0.05 |
| Bireactive monomer: Acrylic acid | 43.4 | 10 | 34.7 | 8 | 52.1 | 12 | 31.0 | 10 | 43.40 | 10 |
| Monomers of vinyl-based resin (segment (A2)) | | | | | | | | | | |
| Styrene | 1202.3 | 84 | 713.6 | 84 | 1347.7 | 84 | 1100.0 | 84 | 1217.40 | 84 |
| 2-Ethylhexyl acrylate | 229.0 | 16 | 135.9 | 16 | 256.7 | 16 | 209.5 | 16 | 231.90 | 16 |
| (A2)/[(A1) + (A2)] × 100 (mass %) | 30.0 | | 20.0 | | 40.0 | | 30.0 | | 30.0 | |

TABLE 6-continued

| Properties | | | | | |
|---|---|---|---|---|---|
| Acid value (mg KOH/g) | 21.4 | 25.4 | 19.6 | 24.2 | 25.4 |
| Softening point (° C.) | 112.4 | 114.7 | 115.4 | 109.6 | 94.1 |
| Glass transition point (° C.) | 55.7 | 59.8 | 51.4 | 52.5 | 52 |
| Melting point, endothermic maximum peak temperature (° C.) | 57.6 | 61.5 | 53.6 | 54.2 | 53.8 |
| Crystallinity index | 2.0 | 1.9 | 2.2 | 2.0 | 1.7 |
| Number-average molecular weight | 2800 | 2900 | 3200 | 3300 | 2900 |
| Weight-average molecular weight | 30000 | 28000 | 35000 | 40000 | 18000 |

| | Core | | | | | | | |
|---|---|---|---|---|---|---|---|---|
| | Production Example 8 | | Production Example 9 | | Production Example 10 | | Production Example 11 | |
| | Resin | | | | | | | |
| | A-6 | | C-1 | | A-7 | | A-8 | |
| | Amount charged (g) | Molar ratio[1)] | Amount charged (g) | Molar ratio[1)] | Amount charged (g) | Molar ratio[1)] | Amount charged (g) | Molar ratio[1)] |
| Monomers of polyester (segment (A1)) (Alcohol component) | | | | | | | | |
| Bisphenol A-PO adduct | 1715 | 70 | | | | | 1715 | 70 |
| Bisphenol A-EO adduct | 682.5 | 30 | | | | | 682.5 | 30 |
| 1,6-Hexanediol | | | 2360 | 100 | | | | |
| 1,2-Propanediol | | | | | 532.2 | 100 | | |
| (Acid component) | | | | | | | | |
| Fumaric acid | | | 2320 | 100 | | | | |
| Alkenyl succinic anhydride | | | | | | | | |
| Terephthalic acid | 697.2 | 60 | | | 697.2 | 60 | 697.2 | 60 |
| Trimellitic anhydride | 201.6 | 15 | | | 268.8 | 20 | 268.8 | 20 |
| Catalyst: Tin (II) 2-ethyl hexanoate | 17.0 | 0.5 | 23.0 | 0.5 | 7.5 | 0.5 | 17.0 | 0.5 |
| Co-catalyst: Gallic acid | 1.7 | 0.05 | | | 0.8 | 0.05 | 1.7 | 0.05 |
| Polymerization initiator: Dibutyl peroxide | — | — | — | — | — | — | 114.5 | 8 |
| Polymerization inhibitor: Tert-butyl catechol | — | — | 2.3 | 0.05 | — | — | — | — |
| Bireactive monomer: Acrylic acid | — | — | — | — | — | — | 43.4 | 10 |
| Monomers of vinyl-based resin (segment (A2)) | | | | | | | | |
| Styrene | — | — | — | — | — | — | 1202.3 | 84 |
| 2-Ethylhexyl acrylate | — | — | — | — | — | — | 229.0 | 16 |
| (A2)/[(A1) + (A2)] × 100 (mass %) | 0.0 | | 0.0 | | 0.0 | | 30.0 | |
| Properties | | | | | | | | |
| Acid value (mg KOH/g) | 21.4 | | 21.3 | | 24.5 | | 23.5 | |
| Softening point (° C.) | 106.4 | | 113.1 | | 118.3 | | 130.7 | |
| Glass transition point (° C.) | 60.4 | | — | | 63.4 | | 58.7 | |
| Melting point, endothermic maximum peak temperature (° C.) | 62.4 | | 110.3 | | 65.8 | | 60.2 | |
| Crystallinity index | 1.7 | | 1.0 | | 1.8 | | 2.2 | |
| Number-average molecular weight | 2800 | | 3600 | | 2700 | | 3500 | |
| Weight-average molecular weight | 9000 | | 8000 | | 19000 | | 48000 | |

Note

[1)]The values of molar ratios of tin (II) 2-ethyl hexanoate, gallic acid and tert-butyl catechol were respectively "part(s) by mass" on the basis of 100 parts by mass of a total amount of an alcohol component and a carboxylic acid component to be subjected to polycondensation reaction. Each molar ratio in the vinyl-based resin is the value based on a total amount of the raw materials of the vinyl-based resin.

TABLE 7

| | Shell | | | | | | | |
|---|---|---|---|---|---|---|---|---|
| | Production Example 12 | | Production Example 13 | | Production Example 14 | | Production Example 15 | |
| | Resin | | | | | | | |
| | B-1 | | B-2 | | B-3 | | B-4 | |
| | Amount charged (g) | Molar ratio[1)] | Amount charged (g) | Molar ratio[1)] | Amount charged (g) | Molar ratio[1)] | Amount charged (g) | Molar ratio[1)] |
| Monomers (Alcohol component) | | | | | | | | |
| 2,3-Butanediol | | | 900 | 50 | | | | |
| 1,2-Propanediol | 1520 | 100 | 760 | 50 | 1520 | 100 | 1520 | 100 |
| Neopentyl glycol | | | | | | | | |
| Ethylene glycol | | | | | | | | |
| Bisphenol A-PO adduct | | | | | | | | |
| Bisphenol A-EO adduct | | | | | | | | |
| (Acid component) | | | | | | | | |
| Fumaric acid | | | | | 464 | 20 | | |
| Alkenyl succinic anhydride | | | | | | | 804 | 15 |
| Terephthalic acid | 2158 | 65 | 2324 | 70 | 2490 | 75 | 1992 | 60 |
| Isophthalic acid | | | | | | | | |
| Trimellitic anhydride | 576 | 15 | 576 | 15 | | | 576 | 15 |
| Catalyst: Tin (II) 2-ethyl hexanoate | 21.3 | 0.5 | 18.3 | 0.5 | 22.4 | 0.5 | 24.5 | 0.5 |
| Co-catalyst: Gallic acid | 2.1 | 0.05 | 1.8 | 0.05 | 2.2 | 0.05 | 2.4 | 0.05 |
| Polymerization inhibitor: Tert-butyl catechol | — | | — | | 2.2 | 0.05 | — | |
| Properties | | | | | | | | |
| Acid value (mg KOH/g) | 23.6 | | 25.1 | | 20.8 | | 20.5 | |
| Softening point (° C.) | 118.4 | | 125.7 | | 99.6 | | 119.8 | |
| Glass transition point (° C.) | 65.7 | | 68.1 | | 62.1 | | 55.2 | |
| Melting point, endothermic maximum peak temperature (° C.) | 67.2 | | 69.4 | | 64.1 | | 57.3 | |
| Crystallinity index | 1.8 | | 1.8 | | 1.6 | | 2.1 | |
| Number-average molecular weight | 2500 | | 2400 | | 2800 | | 3400 | |
| Weight-average molecular weight | 13000 | | 9000 | | 7000 | | 16000 | |

| | Shell | | | | | |
|---|---|---|---|---|---|---|
| | Production Example 16 | | Production Example 17 | | Production Example 18 | |
| | Resin | | | | | |
| | B-5 | | B-6 | | B-7 | |
| | Amount charged (g) | Molar ratio[1)] | Amount charged (g) | Molar ratio[1)] | Amount charged (g) | Molar ratio[1)] |
| Monomers (Alcohol component) | | | | | | |
| 2,3-Butanediol | | | | | | |
| 1,2-Propanediol | | | | | 1520 | 100 |
| Neopentyl glycol | 1040 | 50 | | | | |
| Ethylene glycol | 620 | 50 | | | | |
| Bisphenol A-PO adduct | | | 2450 | 70 | | |
| Bisphenol A-EO adduct | | | 975 | 30 | | |
| (Acid component) | | | | | | |
| Fumaric acid | | | | | | |
| Alkenyl succinic anhydride | | | | | | |
| Terephthalic acid | 2158 | 65 | 1162 | 70 | | |
| Isophthalic acid | | | | | 2158 | 65 |
| Trimellitic anhydride | 576 | 15 | 192 | 10 | 576 | 15 |
| Catalyst: Tin (II) 2-ethyl hexanoate | 22.0 | 0.5 | 23.9 | 0.5 | 21.3 | 0.5 |
| Co-catalyst: Gallic acid | 2.2 | 0.05 | 2.4 | 0.05 | 2.1 | 0.05 |
| Polymerization inhibitor: Tert-butyl catechol | — | | — | | — | |

TABLE 7-continued

| Properties | | | |
|---|---|---|---|
| Acid value (mg KOH/g) | 29.5 | 24.8 | 22.6 |
| Softening point (° C.) | 116.2 | 116.8 | 120.3 |
| Glass transition point (° C.) | 61.2 | 67.4 | 63.7 |
| Melting point, endothermic maximum peak temperature (° C.) | 63.5 | 69.2 | 65.4 |
| Crystallinity index | 1.8 | 1.7 | 1.8 |
| Number-average molecular weight | 2900 | 3000 | 2600 |
| Weight-average molecular weight | 18000 | 14000 | 15000 |

Note

[1)]The values of molar ratios of tin (II) 2-ethyl hexanoate, gallic acid and tert-butyl catechol were respectively "part(s) by mass" on the basis of 100 parts by mass of a total amount of an alcohol component and a carboxylic acid component to be subjected to polycondensation reaction.

Production Examples 19 to 34

(Preparation of Dispersion of Resin Particles)

A 5 L reaction vessel equipped with a stirrer, a reflux condenser, a dropping funnel, a thermometer and a nitrogen inlet tube was charged with 600 g of methyl ethyl ketone, and then 200 g of each of the resins A-1 to A-8, B-1 to B-7 and C-1 produced in Production Examples 3 to 18 were added thereinto at 60° C. to dissolve the respective resins in methyl ethyl ketone. The thus obtained respective solutions were neutralized by adding 4 g of sodium hydroxide thereto. Successively, 2000 g of ion-exchanged water were added to the respective solutions, and then methyl ethyl ketone was distilled off therefrom while stirring at a rate of 250 r/min under reduced pressure at a temperature of 50° C. or lower, thereby obtaining aqueous dispersions of self-dispersible resin particles (resin content: 9.6% by mass (in terms of a solid content)). The volume median particle size of the resin particles dispersed in each of the thus obtained resin particles dispersions was about 0.3 μM.

Production Example 35

(Preparation of Colorant Dispersion)

Fifty grams of copper phthalocyanine (Model No.: "ECB-301" available from Dai-Nichi Seika Kogyo Co., Ltd.), 5 g of a nonionic surfactant (tradename: "EMULGEN 150" available from Kao Corp.) and 200 g of ion-exchanged water were mixed with each other. The resulting mixture was dispersed at 25° C. for 10 min using a homogenizer, thereby obtaining a colorant dispersion. The colorant particles contained in the thus obtained colorant dispersion had a volume median particle size of 120 nm.

Production Example 36

(Preparation of Releasing Agent Dispersion)

Fifty grams of a paraffin wax (tradename: "HNP 0190" available from Nippon Seiroh Co., Ltd.; melting point: 85° C.), 5 g of a cationic surfactant (tradename: "SUNISOLE B50" available from Kao Corp.) and 200 g of ion-exchanged water were mixed and heated to 95° C., and then the paraffin wax was dispersed in the obtained mixture using a homogenizer. The resulting dispersion was subjected to dispersing treatment using a pressure injection type homogenizer, thereby obtaining a releasing agent dispersion. The releasing agent particles contained in the thus obtained releasing agent dispersion had a volume median particle size of 550 nm.

Production Example 37

(Preparation of Charge Controlling Agent Dispersion)

Fifty grams of a charge controlling agent (salicylic acid-based compound; tradename: "BONTRONE E-84" available from Orient Kagaku Kogyo Co., Ltd.), 5 g of a nonionic surfactant (tradename: "EMULGEN 150" available from Kao Corp.) and 200 g of ion-exchanged water were mixed with each other. The resulting mixture was dispersed with glass beads using a sand grinder at 25° C. for 10 min to obtain a charge controlling agent dispersion. The charge controlling agent particles contained in the thus obtained charge controlling agent dispersion had a volume median particle size of 500 nm.

Examples 1 to 11, 13 and 14 and Comparative Examples 1 to 3

(Production of Dispersion of Core-shell Resin Particles and Toner)

A round stainless steel flask was charged with 500 g of the core resin dispersion which was formulated with combination of the resins for core as shown in Table 8, 20 g of the colorant dispersion, 5 g of the releasing agent dispersion, 4 g of the charge controlling agent dispersion and 1.5 g of a cationic surfactant (tradename: "SUNISOLE B50" available from Kao Corp.). The contents of the flask were mixed and dispersed using a homogenizer, and then heated to 48° C. in a heating oil bath while stirring, and further held at 48° C. for 1 h, thereby forming aggregated particles. At this time, the volume median particle size of the obtained aggregated particles was 5.1 μm. Thereafter, 150 g (Examples 1 to 9, 11, 13 and 14 and Comparative Examples 1 to 3), 300 g (Example 10) or 95 g (Example 14) of the shell resin dispersion as shown in Table 8 were added to the resulting dispersion containing the aggregated particles, and the obtained mixed dispersion was dispersed while stirring, thereby obtaining aggregated particles in the form of capsulated core-shell particles.

After adding 3 g of an anionic surfactant (tradename: "Plex SS-L" available from Kao Corp.) to the dispersion of the aggregated particles in the form of core-shell particles, a reflux tube was mounted to the stainless steel flask, and the dispersion was heated to 75° C. at a temperature rise rate of 0.1° C./min while continuously stirring and held at 75° C. for 2 h to unify and fuse the aggregated particles. Thereafter, the resulting dispersion was cooled and then filtered to separate the fused particles therefrom. The thus separated particles were sufficiently washed with ion-exchanged water and then dried, thereby obtaining colored resin fine particles. The colored resin fine particles thus obtained in any of Examples and Comparative Examples had a volume median particle size ($D_{50}$) of 5.0 μm.

Next, 100 parts by mass of the colored resin fine particles were mixed and externally added with 0.5 part by mass of an external additive (hydrophobic silica; tradename: "AEROSIL R-972" available from Nippon Aerosil Co., Ltd.; number-average particle size: 16 nm) using a Henschel mixer (available from Mitsui Mining & Smelting Co., Ltd) at 3600 r/min (peripheral speed: 31.7 m/s) for 5 min, thereby obtaining a toner constituted of toner particles (volume median particle size $D_{50}$: 5.0 μm).

Example 12

The same procedure as in Example 1 was repeated except for using no releasing agent, thereby obtaining a toner constituted of toner particles (volume median particle size $D_{50}$: 5.0 μm). Meanwhile, the colored resin fine particles obtained in the course of production of the toner also had a volume median particle size ($D_{50}$) of 5.0 μm.

[Evaluation]

<Low-Temperature Fusing Property>

The toner was loaded to a modified apparatus of a copying machine (tradename: "AR-505" available from Sharp Corp.) which has been retrofitted such that a fuser therein was capable of toner-fusing and image-fixing operation outside of the apparatus, and solid image printing was conducted using the apparatus to obtain an unfixed solid image having a printed area of 2 cm×12 cm and a deposited toner amount of 0.5 mg/cm$^2$ on a paper (tradename: "Copy Bond SF-70NA" available from Sharp Corp.; 75 g/m$^2$). Further, the solid image printing was conducted two more times on the same paper to form an overlapped unfixed solid image having a layer thickness of 1.5 mg/cm$^2$ thereon. Using the fuser whose total fixing pressure was adjusted to 40 kgf (fixing speed: 300 mm/sec), the unfixed image was fixed at respective fixing temperatures while raising a temperature of a fusing roller from 90° C. to 240° C. at intervals of 5° C. until reaching a minimum fixing temperature. The thus fixed image obtained by passing the paper through the fuser was rubbed with a sand eraser having a bottom surface area of 15 mm×7.5 mm onto which a load of 500 g was applied, by reciprocating the eraser over the fixed image 5 times. Then, optical reflection density values of the fixed image before and after the rubbing were measured using a reflection-type densitometer (tradename: "RD-915" available from Gretag Macbeth GmbH). From the thus measured values, the minimum fixing temperature of the toner was determined as the temperature of the fusing roller at which a ratio between the optical reflection density values of the fixed image before and after the rubbing (optical density after rubbing/optical density before rubbing) first exceeded 80%. The lower the minimum fixing temperature, the more excellent the low-temperature fusing property of the toner became. The results are shown in Table 8.

As shown in Table 8, in all of Examples (Examples 1 to 14), the result of evaluation for low-temperature fusing property of each of the toners was lower than 140° C., and therefore it was confirmed that the toners were excellent in low-temperature fusing property.

On the other hand, in Comparative Example 1, the result of evaluation for low-temperature fusing property of the toner was 145° C., and therefore it was confirmed that the toner was deteriorated in low-temperature fusing property. The reason therefor is considered as follows. That is, in Comparative Example 1, no aliphatic diol having 2 to 6 carbon atoms was used as the alcohol component of the shell portion, and a propyleneoxide adduct of 2,2-bis(4-hydroxyphenyl)propane and an ethyleneoxide adduct of 2,2-bis(4-hydroxyphenyl) propane were used instead thereof. For this reason, it is considered that the shell portion had a high hydrophobicity and therefore exhibited a high compatibility with the core portion, so that it was not possible to sufficiently maintain a core-shell structure of the toner.

(Anti-Hot Offset Property)

Upon the above evaluation of low-temperature fusing property, the toner was also visually observed to determine whether or not any hot offset occurred therein. The temperature at which hot offset of the toner occurred was measured and confirmed as an anti-hot offset property of the toner. The higher the temperature at which hot offset of the toner occurred, the more excellent the anti-hot offset property of the toner became. The results are shown in Table 8.

As shown in 8, in all of Examples (Examples 1 to 14), the result of evaluation for anti-hot offset property of each of the toners was 190° C. or higher, and therefore it was confirmed that the toners were excellent in anti-hot offset property.

On the other hand, in Comparative Example 2, the result of evaluation for anti-hot offset property of the toner was 170° C., and therefore it was confirmed that the toner was deteriorated in anti-hot offset property. The reason therefor is considered as follows. That is, in Comparative Example 2, no segment (A2) formed of the styrene-containing addition polymer as a constitutional unit thereof was used in the core portion, so that the releasing agent was not sufficiently dispersed inside of the core portion. For this reason, it is considered that the releasing agent was exposed to a surface of the toner, resulting in deteriorated anti-hot offset property of the toner.

(Heat-Resistant Storage Property)

Ten grams of the toner were charged into a 50 mL polymeric cup and stored under environmental conditions of 55° C. and 60% RH for 24 h. Thereafter, three sieves including a sieve A (mesh size: 250 μm), a sieve B (mesh size: 150 μm) and a sieve C (mesh size: 75 μm) were disposed on a powder tester (available from Hosokawa Micron Corp.) in an overlapped manner in the order of the sieve A, the sieve B and the sieve C from above, and 10 g of the toner were placed on the sieve A and vibrated for 60 s. The larger value (α) calculated according to the following formula indicates a more excellent fluidity and a more excellent heat-resistant storage property of the toner.

$$\alpha=100-(WA+WB\times0.6+WC\times0.2)/10\times100$$

wherein WA is a mass (g) of the toner remaining on the sieve A; WB is a mass (g) of the toner remaining on the sieve B; and WC is a mass (g) of the toner remaining on the sieve C.

As shown in Table 8, in all of Examples (Examples 1 to 14), the a value was 50 or more, and therefore it was confirmed that the toners were excellent in heat-resistant storage property.

TABLE 8

| | Core/ shell | Mixing ratio of resins (mass ratio) | Releasing agent Molar ratio of releasing agent/amorphous resin (A) | Low-temperature fusing property Temperature (° C.) | Anti-hot offset property (offset generating temperature) Temperature (° C.) | Heat-resistant storage property (α) |
|---|---|---|---|---|---|---|
| Example 1 | A-1/B-1 | 100/30 | 0.02 | 120 | 200 or higher | 98.5 |
| Example 2 | A-2/B-1 | 100/30 | 0.02 | 130 | 200 | 99.1 |
| Example 3 | A-3/B-1 | 100/30 | 0.02 | 135 | 200 or higher | 86.4 |
| Example 4 | A-4/B-1 | 100/30 | 0.02 | 120 | 200 or higher | 76.5 |
| Example 5 | A-5/B-1 | 100/30 | 0.02 | 115 | 190 | 73.2 |
| Example 6 | A-5/B-2 | 100/30 | 0.02 | 135 | 195 | 81.6 |
| Example 7 | A-1/B-3 | 100/30 | 0.02 | 120 | 190 | 76.2 |
| Example 8 | A-1/B-4 | 100/30 | 0.02 | 120 | 195 | 56.4 |
| Example 9 | A-1/B-5 | 100/30 | 0.02 | 120 | 200 | 61.9 |
| Example 10 | A-1/B-1 | 100/60 | 0.02 | 135 | 200 or higher | 99.2 |
| Example 11 | A-1·C-1/B-1*[1] | 100/30 | 0.02 | 115 | 200 or higher | 52.3 |
| Example 12 | A-1/B-7 | 100/30 | 0 | 120 | 190 | 78.6 |
| Example 13 | A-8/B-1 | 100/30 | 0.02 | 135 | 200 or higher | 97.9 |
| Example 14 | A-1/B-1 | 100/19 | 0.02 | 120 | 190 | 60.5 |
| Comparative Example 1 | A-2/B-6 | 100/30 | 0.02 | 145 | 190 | 56.3 |
| Comparative Example 2 | A-6/B-1 | 100/30 | 0.02 | 125 | 170 | 58.6 |
| Comparative Example 3 | A-7/B-1 | 100/30 | 0.02 | 140 | 170 | 55 |

Note
*[1]Mixing ratio of A-1 to C-1 (A-1/C-1) was 80/20 (mass ratio).

In Comparative Example 1 in which no aliphatic diol having 2 to 6 carbon atoms was contained in the alcohol component as the raw material of the resin B-7 for the shell, the resulting toner was deteriorated in low-temperature fusing property and heat-resistant storage property.

In Comparative Example 2 in which the resin A-6 for the core was a polyester resin and contained no segment formed of an addition polymer, the resulting toner was deteriorated in anti-hot offset property and heat-resistant storage property.

The toner obtained in Comparative Example 3 was deteriorated in low-temperature fusing property, anti-hot offset property and heat-resistant storage property. The reason therefor is considered to be that the core and shell of the toner both contained an aliphatic diol having 2 to 6 carbon atoms as a raw material component thereof and therefore a compatibility between the core and shell became high, so that it was not possible to sufficiently maintain a core-shell structure of the toner.

Industrial Applicability

The toner according to the present invention is excellent in low-temperature fusing property and heat-resistant storage property, and can be therefore suitably used as a toner for electrophotography which is employed in an electrophotographic method, an electrostatic recording method, an electrostatic printing method and the like.

The invention claimed is:

1. A toner for electrophotography, comprising core-shell particles, wherein the core-shell particles comprise:

a core, comprising an amorphous composite resin (A) which comprises a segment (A1) formed of a polyester resin and a segment (A2) formed of a styrene-containing addition polymer as a constitutional unit thereof, and a shell, comprising an amorphous resin (B) obtained by polycondensing an alcohol component comprising an aliphatic diol having 2 to 6 carbon atoms with a carboxylic acid component, wherein the segment (A1) comprises an alcohol component, wherein a content of an aromatic diol in the alcohol component of the segment (A1) is from 50 to 100 mol %, wherein a content of the aliphatic diol having 2 to 6 carbon atoms in the alcohol component of the amorphous resin (B) is from 80 to 100 mol %.

2. The toner for electrophotography according to claim 1, wherein a mass ratio of the segment (A1) formed of the polyester resin to the segment (A2) formed of the styrene-containing addition polymer as a constitutional unit thereof [(A1)/(A2)] in the amorphous composite resin (A) is from 50/50 to 95/5.

3. The toner for electrophotography according to claim 1, wherein the amorphous composite resin (A) has a softening point of from 80 to 150° C.

4. The toner for electrophotography according to claim 1, wherein the amorphous resin (B) is present in an amount of from 10 to 120 parts by mass on the basis of 100 parts by mass of the amorphous composite resin (A).

5. The toner for electrophotography according to claim 1, wherein the core comprises a releasing agent.

6. The toner for electrophotography according to claim 1, wherein a content of an alkyleneoxide adduct of 2,2-bis(4-hydroxyphenyl)propane in the alcohol component of the segment (A1) is from 50 to 100 mol %.

7. The toner for electrophotography according to claim 1, wherein a content of an aromatic dicarboxylic acid compound in a carboxylic acid component of the segment (Al) is from 30 to 95 mol %.

8. The toner for electrophotography according to claim 1, wherein the aliphatic diol having 2 to 6 carbon atoms which is present in the amorphous resin (B) is at least one compound selected from the group consisting of 2,3-butanediol, 1,2-propanediol, neopentyl glycol and ethylene glycol.

9. The toner for electrophotography according to claim 1, wherein a content of an aromatic dicarboxylic acid compound in the carboxylic acid component of the amorphous resin (B) is from 30 to 95 mol %.

10. The toner for electrophotography according to claim 1, wherein the carboxylic acid component of the amorphous resin (B) comprises a trivalent or higher-valent polycarboxylic acid compound.

11. The toner for electrophotography according to claim 1, wherein the segment (A2) comprises a bireactive monomer.

12. The toner for electrophotography according to claim 11, wherein the bireactive monomer is at least one compound selected from the group consisting of acrylic acid and methacrylic acid.

13. The toner for electrophotography according to claim 11, wherein in the amorphous composite resin (A), the segment (A1) formed of the polyester resin and the segment (A2) formed of the styrene-containing addition polymer as a constitutional unit thereof are bonded to each other through the bireactive monomer present in the segment (A2) as a bonding site therebetween.

14. The toner for electrophotography according to claim 1, wherein the bireactive monomer is present in an amount of from 1 to 40 mol parts on the basis of 100 mol parts of the carboxylic acid component of the segment (A1).

15. The toner for electrophotography according to claim 1, wherein the segment (A2) comprises a (meth)acrylic acid ester.

16. The toner for electrophotography according to claim 1, wherein a content of a constitutional unit derived from styrene in the segment (A2) is from 60 to 100% by mass.

17. A process for producing the toner for electrophotography including core-shell particles as defined in claim 1, said process comprising:

preparing an aqueous dispersion of resin particles I comprising the amorphous composite resin (A) which comprises the segment (A1) formed of the polyester resin and the segment (A2) formed of the styrene-containing addition polymer as a constitutional unit thereof;

mixing the aqueous dispersion of the resin particles I obtained in said preparing with a resin aqueous dispersion comprising the amorphous resin (B) obtained by polycondensing an alcohol component comprising an aliphatic diol having 2 to 6 carbon atoms with a carboxylic acid component to aggregate the resin particles I and the amorphous resin (B), thereby preparing an aqueous dispersion of resin particles II; and coalescing the resin particles II obtained in said mixing.

18. The process for producing the toner for electrophotography according to claim 17, wherein, in said preparing, the aqueous dispersion of the resin particles I is prepared by subjecting a resin aqueous dispersion comprising the amorphous composite resin (A) to aggregation.

19. The process for producing the toner for electrophotography according to claim 17, wherein, in said preparing, the aqueous dispersion of the resin particles I is prepared by aggregating resin particles comprising the amorphous composite resin (A) and a releasing agent.

* * * * *